US009099036B2

(12) United States Patent
Kitazawa

(10) Patent No.: US 9,099,036 B2
(45) Date of Patent: Aug. 4, 2015

(54) ACTIVE-MATRIX-TYPE LIGHT-EMITTING DEVICE, ELECTRONIC APPARATUS, AND PIXEL DRIVING METHOD FOR ACTIVE-MATRIX-TYPE LIGHT-EMITTING DEVICE

(75) Inventor: Takayuki Kitazawa, Suwa (JP)

(73) Assignee: SEIKO EPSON CORPORATION, Tokyo (JP)

( * ) Notice: Subject to any disclaimer, the term of this patent is extended or adjusted under 35 U.S.C. 154(b) by 1463 days.

(21) Appl. No.: 11/776,236

(22) Filed: Jul. 11, 2007

(65) Prior Publication Data

US 2008/0036706 A1 Feb. 14, 2008

(30) Foreign Application Priority Data

Aug. 9, 2006 (JP) ..... 2006-216956

(51) Int. Cl.
*G09G 3/32* (2006.01)

(52) U.S. Cl.
CPC ..... *G09G 3/3233* (2013.01); *G09G 3/3266* (2013.01); *G09G 3/3283* (2013.01); *G09G 2300/0439* (2013.01); *G09G 2300/0819* (2013.01); *G09G 2300/0838* (2013.01); *G09G 2300/0842* (2013.01); *G09G 2300/0852* (2013.01); *G09G 2300/0866* (2013.01); *G09G 2300/0876* (2013.01); *G09G 2310/0262* (2013.01); *G09G 2310/0289* (2013.01); *G09G 2320/043* (2013.01)

(58) Field of Classification Search
CPC ..... G09G 2300/0439–2300/0465; G09G 2300/0809–2300/0871
USPC ..... 345/76–104
See application file for complete search history.

(56) References Cited

U.S. PATENT DOCUMENTS

| | | | | |
|---|---|---|---|---|
| 5,994,922 | A * | 11/1999 | Aoki et al. | 326/87 |
| 6,930,680 | B2 | 8/2005 | Miyazawa | |
| 7,126,565 | B2 | 10/2006 | Kawasaki et al. | |
| 7,221,341 | B2 | 5/2007 | Kawasaki et al. | |
| 2002/0008688 | A1 * | 1/2002 | Yamamoto et al. | 345/98 |
| 2002/0060592 | A1 * | 5/2002 | Shimoda | 327/170 |
| 2003/0231152 | A1 * | 12/2003 | Shin | 345/83 |
| 2005/0168490 | A1 | 8/2005 | Takahara | |
| 2005/0168491 | A1 | 8/2005 | Takahara et al. | |

(Continued)

FOREIGN PATENT DOCUMENTS

| | | |
|---|---|---|
| CN | 1426041 A | 6/2003 |
| JP | A-2004-145296 | 5/2004 |

(Continued)

*Primary Examiner* — Michael Pervan
(74) *Attorney, Agent, or Firm* — Oliff PLC

(57) ABSTRACT

An active-matrix-type light-emitting device includes: a pixel circuit including a light-emitting element, a driving transistor that drives the light-emitting element, a holding capacitor whose one end is connected to the driving transistor and which stores electric charges corresponding to written data, at least a control transistor that controls an operation associated with writing of data into the holding capacitor, and an emission control transistor; a first scanning line for controlling ON/OFF of the control transistor and a second scanning line for controlling ON/OFF of the emission control transistor; a data line through which the written data is transmitted to the pixel circuit; and a scanning line driving circuit which drives the first and second scanning lines and in which a current drive capability associated with the second scanning line is set to be lower than a current drive capability associated with the first scanning line.

17 Claims, 14 Drawing Sheets

(56) References Cited

U.S. PATENT DOCUMENTS

| | | | | |
|---|---|---|---|---|
| 2005/0180083 | A1 | 8/2005 | Takahara et al. | |
| 2005/0243040 | A1 | 11/2005 | Miyazawa | |
| 2005/0259052 | A1* | 11/2005 | Shin | 345/77 |
| 2006/0022912 | A1* | 2/2006 | Park et al. | 345/76 |
| 2008/0084365 | A1 | 4/2008 | Takahara et al. | |

FOREIGN PATENT DOCUMENTS

| | | | |
|---|---|---|---|
| JP | A-2006-017966 | | 1/2006 |
| WO | WO 03/091978 | A1 | 11/2003 |

* cited by examiner

ACTIVE-MATRIX-TYPE LIGHT-EMITTING DEVICE, ELECTRONIC APPARATUS, AND PIXEL DRIVING METHOD FOR ACTIVE-MATRIX-TYPE LIGHT-EMITTING DEVICE

BACKGROUND

1. Technical Field

The present invention relates to an active-matrix-type light-emitting device and a pixel driving method for the active-matrix-type light-emitting device. In particular, the invention relates to a technique for effectively preventing black float (a phenomenon in which an unnecessary current flows even at the time of black display and a light-emitting element emits a small amount of light to thereby increase a black level, and as a result, the contrast decreases) at the time of black display of a pixel having a self-luminous element, such as an electroluminescent (EL) element.

2. Related Art

In recent years, an electroluminescent (EL) element having features, such as a high efficiency, a small film thickness, a light weight, and a low dependency on viewing angle, has been drawing attention and a display using the EL element is under active development. The EL element is a self-luminous element that emits light via application of an electric field to a fluorescent compound and is classified into one of two types, namely, an inorganic EL element using an inorganic compound, such as zinc sulfide, as a light-emitting material layer or an organic EL element using an organic compound, such as diamines, as a light-emitting material layer.

Since the organic EL element is advantageous in that obtaining different colors is easy and the organic EL element can operate at a low-voltage DC current that is much lower than that required for the inorganic EL element, application of the organic EL element to, for example, a display device of a portable terminal is expected in the near future.

The organic EL element is configured such that organic molecules forming an emission center are excited by injecting holes into a light-emitting material layer through a hole injection electrode and injecting electrons into the light-emitting material layer through an electron injection electrode and then causing the injected holes and electrons to be recombined, and fluorescent light is emitted when the excited organic molecules return to a ground states. Accordingly, an emission color of the organic EL element can be changed by selecting a fluorescent material used to form the light-emitting material layer.

In the organic EL element, electric charges are accumulated when a positive voltage is applied to a transparent electrode, which is an anode, and a negative voltage is applied to a metal electrode, which is a cathode, and a current starts to flow when a voltage value exceeds a barrier voltage unique to an element. Then, emission having an intensity that is approximately proportional to the DC current value occurs. That is, it can be said that the organic EL element is a current driving type self-luminous element like a laser diode, a light-emitting diode, and so on.

Methods of driving an organic EL display device are broadly classified into a passive matrix method and an active matrix method. In the case of the passive matrix driving method, the number of display pixels is limited and there are limitations in terms of lifetime and power consumption. For this reason, in many cases, an active-matrix-type driving method that is advantageous in realizing a display, for which a large area and high precision are requested, is used as a method of driving an organic EL display device. Accordingly, a display using the active-matrix-type driving method is under active development.

In the display device using the active-matrix-type driving method, a polysilicon thin-film transistor (polysilicon TFT) serving as an emission control transistor is formed for each of a plurality of electrodes in order to independently drive an organic EL element formed on each electrode, the electrodes of the polysilicon thin-film transistors being patterned in a dot matrix arrangement. In addition, the polysilicon TFT may also be used as a driving transistor for driving an organic EL element or a control transistor for controlling an operation related to data writing.

In the following description, the polysilicon TFT may be simply referred to as "TFT". In the case of the "TFT", a material thereof is not limited to polysilicon. For example, the material may be amorphous silicon.

An emission gray scale of an organic EL element is greatly affected by the characteristics of a TFT. In JP-A-2006-17966, considering that electric charges stored in a holding capacitor fluctuate due a leak current (optical leak current) generated in a TFT driven through a scanning line when light is illuminated, the fluctuation of the electric charges is suppressed by inserting a diode.

In JP-A-2006-17966, the optical leak current of the TFT is an issue. However, the leak current generated in the TFT also includes a leak current (dark current) generated when the TFT is in an OFF state and a leak current generated due to a circuit operation. Accordingly, it is necessary to examine the leak currents described above in a comprehensive way.

The inventor of the invention has studied the occurrence of a phenomenon (black float) in which a small but unnecessary current flows at the time of black display (that is, a state in which a current from a driving transistor is not supplied even though an emission control transistor is in an ON state, and as a result, a light-emitting element maintains a non-emission state) of an active-matrix-type light-emitting device, the light-emitting element emits light to thereby raise a black level, and accordingly, the contrast decreases and has examined the cause of the phenomenon in a comprehensive way.

It was determined that an instantaneous and large leak current, which is generated due to a circuit operation, is strongly related to generation of black float.

That is, when shifting an emission control transistor from an OFF state to an ON state by changing the electric potential of a scanning line, a changed component of the electric potential of the scanning line leaks to a light-emitting element through a parasitic capacitance between a gate and a source of the emission control transistor. As a result, a large amount of current flows instantaneously. This current is referred to as a "coupling current" In the following description. The "coupling current" is a current resulting from a transitional pulse that is coupled to a light-emitting element through the parasitic capacitance of the emission control transistor.

When the coupling current flows, the light-emitting element instantaneously emits light even though black display is being performed. As a result, since a black level rises, the contrast decreases, thus since this phenomenon is easily registered by the human eye, there is a direct association with deterioration of the quality of a display image.

That is, it is apparent from the inventor's examination that an important factor directly associated with decrease in the contrast at the time of black display is a leak current, which is generated due to a problem related to a circuit, not a leak current based on the physical characteristics of a TFT, which has been an issue in the related art.

SUMMARY

An advantage of some aspects of the invention is to effectively suppress the contrast at the time of black display of an active-matrix-type light-emitting device from decreasing without complicating the circuit configuration.

According to an aspect of the invention, an active-matrix-type light-emitting device includes: a pixel circuit including a light-emitting element, a driving transistor that drives the light-emitting element, a holding capacitor whose one end is connected to the driving transistor and which stores electric charges corresponding to written data, at least one control transistor that controls an operation associated with writing of data into the holding capacitor, and an emission control transistor provided between the light-emitting element and the driving transistor; a first scanning line for controlling ON/OFF of the control transistor and a second scanning line for controlling ON/OFF of the emission control transistor; a data line through which the written data is transmitted to the pixel circuit; and a scanning line driving circuit which drives the first and second scanning lines and in which a current drive capability associated with the second scanning line is set to be lower than a current drive capability associated with the first scanning line.

By intentionally decreasing the current drive capability associated with the second scanning line, the rising waveform of a driving pulse of the emission control transistor becomes gentle (that is, change of a voltage with respect to time becomes gentle. Accordingly, it is possible to suppress an instantaneous current (coupling current) whose peak current value is large from flowing through the parasitic capacitance of the emission control transistor. As a result, since the increase in black level at the time of black display is reduced, it is not necessary to worry about deterioration of the quality of a display image occurring due to decrease in the contrast. In addition, since it is easy to adjust the current drive capability associated with the second scanning line in the scanning mine driving circuit and it is not necessary to provide an additional circuit, it is easy to realize the active-matrix-type light-emitting device without complicating the circuit configuration.

In the active-matrix-type light-emitting device according to the aspect of the invention, preferably, the scanning line driving circuit includes first and second output buffers for driving the first and second scanning lines, respectively, and the size of a transistor included in the second output buffer is smaller than that of a transistor included in the first output buffer.

The current drive capability associated with the second scanning line is intentionally set to be lower than the current drive capability associated with the first scanning line by adjusting the size of a transistor included in an output-stage buffer. Here, the "size of a transistor" is not limited to only a "size in a case of comparing the size of one transistor". For example, in the case of an output buffer for driving the first scanning line, a plurality of transistors each having a unit size are connected in parallel to each other. On the other hand, in the case of an output buffer for driving the second scanning line, only one transistor having a unit size may be used (assuming that transistors connected in parallel to each other are one transistor, it can be considered that the size of a transistor changes).

Further, in the active-matrix-type light-emitting device according to the aspect of the invention, preferably, the transistors included in the first and second output buffers are insulation gate type field effect transistors, and the channel conductance (W/L) of the transistor included in the second output buffer is smaller than that of the transistor included in the first output buffer.

The current drive capability associated with the second scanning line is intentionally set to be lower than the current drive capability associated with the first scanning line by adjusting the channel conductance (gate width W/gate length L) of a MOS transistor included in an output buffer.

Furthermore, in the active-matrix-type light-emitting device according to the aspect of the invention, preferably, the scanning line driving circuit includes first and second output buffers for driving the first and second scanning lines, respectively, and a resistor is connected to an output end of the second output buffer in order to set a current drive capability associated with the second scanning line to be lower than a current drive capability associated with the first scanning line.

By restricting the amount of a current with insertion of a resistor, the current drive capability associated with the second scanning line becomes lower than the current drive capability associated with the first scanning line. The resistor may be regarded as a constituent component of a time constant circuit for making the voltage change of the second scanning line gentle. Even if the sizes of transistors included in output-stage buffers are equal, only the current drive capability associated with the second scanning line can be reduced by providing a resistor for only an output buffer for driving the second scanning line. In addition, by making the size of a transistor included in an output-stage buffer small and inserting a resistor, it may be possible to make a fine adjustment on the current drive capability.

Furthermore, in the active-matrix-type light-emitting device according to the aspect of the invention, preferably, the driving transistor is an insulation gate type field effect transistor. In addition, preferably, the current amount of a coupling current is reduced by decreasing a current drive capability associated with the second scanning line, such that unnecessary emission of the light-emitting element at the time of black display is suppressed, the coupling current being generated in a case when a changed component of an electric potential of the second scanning line leaks to the light-emitting element through a parasitic capacitance between a gate and a source of the emission control transistor when shifting the emission control transistor from an OFF state to an ON state by changing an electric potential of the second scanning line.

The coupling current generated due to a problem related to a circuit is an important factor directly associated with decrease in the contrast at the time of black display. Accordingly, the invention clarifies a point that reduction of the coupling current is a problem to be preferentially solved.

Furthermore, in the active-matrix-type light-emitting device according to the aspect of the invention, preferably, the emission control transistor and the light-emitting element are disposed on a substrate so as to be close to each other.

For the purpose of high integration, the emission control transistor and the light-emitting element need to be disposed on a substrate so as to be close to each other. In this case, the coupling current flowing through the parasitic capacitance of the emission control transistor is supplied to the light-emitting element without being attenuated. That is, the black float phenomenon becomes noticeable. According to the aspect of the invention, since it is possible to suppress the increase in black level without providing an additional circuit, the contrast does not decrease even in the active-matrix-type light-emitting device that is highly integrated.

Furthermore, in the active-matrix-type light-emitting device according to the aspect of the invention, preferably, a current drive capability associated with the second scanning line is adjusted such that a period of time from the start of change of an electric potential of the second scanning line to convergence of the change is one horizontal synchronization period (1 H) or more.

By setting the period of time until the electric potential change of the second scanning line to one horizontal synchronization period (1 H) or more (that is, setting the CR time constant to 1 H or more assuming that the second scanning line is a CR time constant circuit), steep change of an electric potential is prevent. As a result, it is possible to reliably prevent an instantaneous coupling current, of which a peak value is large, from being generated.

Furthermore, in the active-matrix-type light-emitting device according to the aspect of the invention, preferably, the control transistor driven through the first scanning line is a switching transistor connected between the data line and a common connection point between the holding capacitor and the driving transistor, the switching transistor performs an ON/OFF operation at least once during one horizontal synchronization period (1 H) and the emission control transistor driven through the second scanning line performs an ON/OFF operation at least once during a predetermined period within one vertical synchronization period (1 V).

The control transistor (switching transistor) driven through the first scanning line needs to be switched in sufficiently shorter time (several hundreds of nanoseconds (ns) to several microseconds (μs)) than one horizontal period (1 H), within the one horizontal period. In contrast, in the case of the emission control transistor driven through the second scanning line of which the current drive capability is weakened, it is sufficient that the emission control transistor performs an ON/OFF operation during only a predetermined period within one vertical synchronization period (1 V). In addition, a predetermined margin is generally allowed between "ON" timing of the emission control transistor and operation timing of other transistors. Therefore, even if the drive capability of the second scanning line is intentionally reduced a little, delay in a circuit operation does not cause any particular problem if the driving timing is adjusted by efficiently using the timing margin. In addition, in the case of the emission control transistor, frequent and high-speed ON/OFF is not requested, unlike the other control transistors. Therefore, even in this point of view, any particular problem does not occur. As a result, even if the drive capability of the second scanning line is intentionally reduced, any particular problem does not occur in association with an actual circuit operation.

Furthermore, in the active-matrix-type light-emitting device according to the aspect of the invention, preferably, the pixel circuit is a pixel circuit using a current programming method, in which an emission gray scale of the light-emitting element is adjusted by controlling electric charges stored in the holding capacitor by means of a current flowing through the data line, or a pixel circuit using a voltage programming method, in which the emission gray scale of the light-emitting element is adjusted by controlling the electric charges stored in the holding capacitor by means of a voltage signal transmitted through the data line.

The invention may be applied to both the active-matrix-type light-emitting device based on the current programming method and the active-matrix-type light-emitting device based on the voltage programming method.

Furthermore, in the active-matrix-type light-emitting device according to the aspect of the invention, preferably, the pixel circuit is a pixel circuit that uses a current programming method and has a circuit configuration for compensating for a change in a threshold voltage of an insulation gate type field effect transistor serving as the driving transistor, the control transistor driven through the first scanning line is a write transistor having an end connected to the data line and the other end connected to an end of a coupling capacitor, and the other end of the coupling capacitor is connected to a common connection point between the holding capacitor and the driving transistor.

Since fluctuation of a driving current caused by variation of the threshold voltage of the driving transistor can be suppressed, a leak current while the driving transistor is in an OFF state (leak current at the time of black display) is reduced and the increase in black level caused by a coupling current is suppressed. As a result, black display corresponding to a desired level is reliably realized.

Furthermore, in the active-matrix-type light-emitting device according to the aspect of the invention, preferably, the light-emitting element is an organic electroluminescent element (organic EL element).

Since the organic EL element is advantageous in that coloring is easy and the organic EL element can operate with a low-voltage DC current that is extremely lower than that in an inorganic EL element, the organic EL element is expected to be used as a large-sized display panel and the like in recent years. According to the aspect of the invention, it is possible to realize a high-quality organic EL panel in which the increase in black level caused by a coupling current can be suppressed.

In addition, according to another aspect of the invention, there is provided an electronic apparatus including the active-matrix-type light-emitting device described above.

The active-matrix-type light-emitting device is advantageous in realizing a display panel for which a large area and high precision are requested. In addition, the active-matrix-type light-emitting device according to the aspect of the invention is devised such that decrease in the contrast does not occur. Accordingly, the active-matrix-type light-emitting device according to the aspect of the invention may be used as, for example, a display device of an electronic apparatus.

In the electronic apparatus according to the aspect of the invention, preferably, the active-matrix-type light-emitting device is used as a display device or a light source.

The active-matrix-type light-emitting device according to the aspect of the invention may be used, for example, as a display panel mounted in a portable terminal or an indicator of equipment such as a car navigation system, which is mounted in a car. In addition, the active-matrix-type light-emitting device according to the aspect of the invention may also be used as a display device with high brightness and a large-sized screen. In addition, for example, the active-matrix-type light-emitting device according to the aspect of the invention may also be used as a light source in a printer.

In addition, according to still another aspect of the invention, a pixel driving method for an active-matrix-type light-emitting device of performing ON/OFF driving for a control transistor and an emission control transistor through first and second scanning lines, respectively, in a pixel circuit including a light-emitting element, a driving transistor that drives the light-emitting element, a holding capacitor whose one end is connected to the driving transistor and which stores electric charges corresponding to written data, at least one control transistor that controls an operation associated with writing of data into the holding capacitor, and the emission control transistor provided between the light-emitting element and the driving transistor includes: setting a current drive capability associated with the second scanning line to be lower than a current drive capability associated with the first scanning line. A coupling current is reduced due to the setting, such that unnecessary emission of the light-emitting element at the time of black display is suppressed, the coupling current being generated in a case when a changed component of an electric potential of the second scanning line leaks to the light-emitting element through a parasitic capacitance between a gate and a source of the emission control transistor when shifting the emission control transistor from an OFF state to an ON state by changing an electric potential of the second scanning line.

In the pixel driving method according to the aspect of the invention, the coupling current can be reduced by decreasing the drive capability of the second scanning line, and accordingly, it is possible to effectively suppress the increase in black level.

BRIEF DESCRIPTION OF THE DRAWINGS

The invention will be described with reference to the accompanying drawings, wherein like numbers reference like elements.

DESCRIPTION OF EXEMPLARY EMBODIMENTS

Before describing specific embodiments of the invention, the results of a study conducted by the inventor of the invention on a leak current of a TFT in an active-matrix-type pixel circuit will be explained.

Figure 14A:
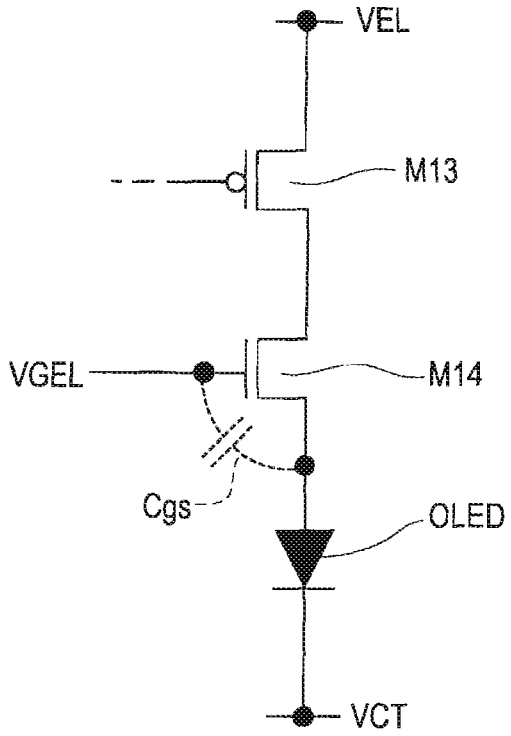
FIG. 14A is a view for explaining a leak current of a TFT in an active-matrix-type pixel circuits specifically, a circuit diagram illustrating main parts of a pixel circuit.
Figure 14B:
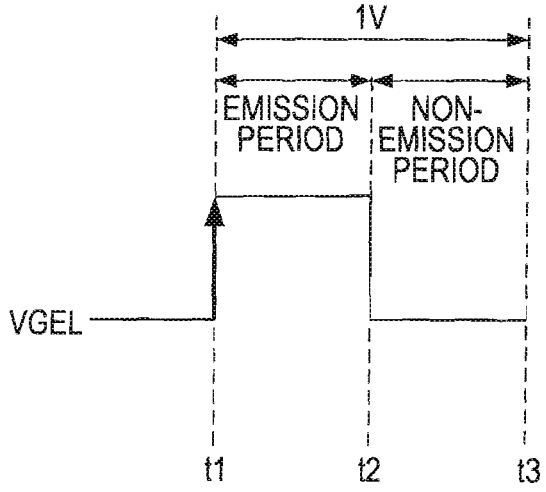
FIG. 14B is a view for explaining a leak current of a TFT in an active-matrix-type pixel circuit, specifically, a timing chart for explaining the kinds of a leak current generated by an operation of a light-emitting element.

FIGS. 14A and 14B are views for explaining a leak current of a TFT in an active-matrix-type pixel circuit. That is, FIG. 14A is a circuit diagram illustrating main parts of a pixel circuit, and FIG. 14B is a timing chart for explaining the types of leak current generated by an operation of a light-emitting element.

In the circuit shown in FIG. 14A, M13 denotes a driving transistor (P-channel MOSTFT), M14 denotes an emission control transistor (NMOSTFT) serving as a switching element, and OLED denotes an organic EL element serving as a lights emitting element. The emission control transistor M14 is ON/OFF controlled by an emission control signal GEL. In the emission control transistor M14, a parasitic capacitance Cgs exists between a gate and a source. In addition, VEL and VCT are pixel power supply voltages.

An operation state of the organic EL element OLED is divided into an emission period (time t1 to time t2) and non-emission period (time t2 to time t3), as shown in FIG. 14B. Moreover, an emission control signal (emission control pulse: GEL) rises from a low level to a high level at time t1 and falls from a high level to a low level at time t2. A period from time t1 to time t3 is equivalent to one vertical synchronization period (1V).

In the following description, "Black" display is assumed. That is, in the circuit shown in FIG. 14A, it is ideal that the driving transistor M13 holds an OFF state such that a driving current does not flow even for the emission period (time t1 to time t2) of the light-emitting element OLED. However, a leak current actually exists. Leak current components in the circuit shown in FIG. 14A may be divided into three types.

The first type is a pixel current (first leak current) flowing during a period (time t1 to t2) for which an emission control signal is at a high level. The first leak current is a leak current when the driving transistor (PMOSTFT) M13 is in an OFF state.

The second type is a pixel current (second leak current) flowing during a period (time t2 to t3) for which the emission control signal is at a low level. The second leak current is a leak current when the emission control transistor (NMOSTFT) M14 is in an OFF state. In general, the amount of the first leak current is larger than the amount of the second leak current.

Furthermore, the third type is a third leak current flowing due to a voltage change component of the emission control signal GEL, which leaks to the light-emitting element OLED through the gate-source capacitance Cgs of the emission control transistor M14 at the time the level of the emission control signal (emission control pulse: GEL, rises (time t1). In this specification, the third leak current is referred to as "coupling current". This is based on consideration that the third leak current is generated since the emission control signal GEL is coupled with the light-emitting element OLED through the parasitic capacitance Cgs. In the related art, the third leak current (coupling current) in most cases is not considered.

Taking the three kinds of leak current into consideration, the total leak current (Ileak) in the circuit shown in FIG. 14A may be expressed by expression 1 given below.

$$Ileak=n\times Igel+d\times Ioffp+(1-d)\times Ioffn \quad (1)$$

Here, n is the number of light emissions in one frame, d is an emission duty (ratio of an emission period to a 1 V period; $0\leq d\leq 1$), Igel is a coupling current resulting from coupling of the GEL signal, Ioffp is a leak current (OFF current) at the time of OFF of the PMOSTFT (driving transistor M13), and Ioffn is a leak current (OFF current) at the time of OFF of the NMOSTFT (emission control transistor M14).

It is apparent from an experimental result (refer to FIG. 15) obtained by the inventor of the invention that an actual leak current can be simulated with high precision using a leak current model based on expression 1 shown above.

Figure 15:
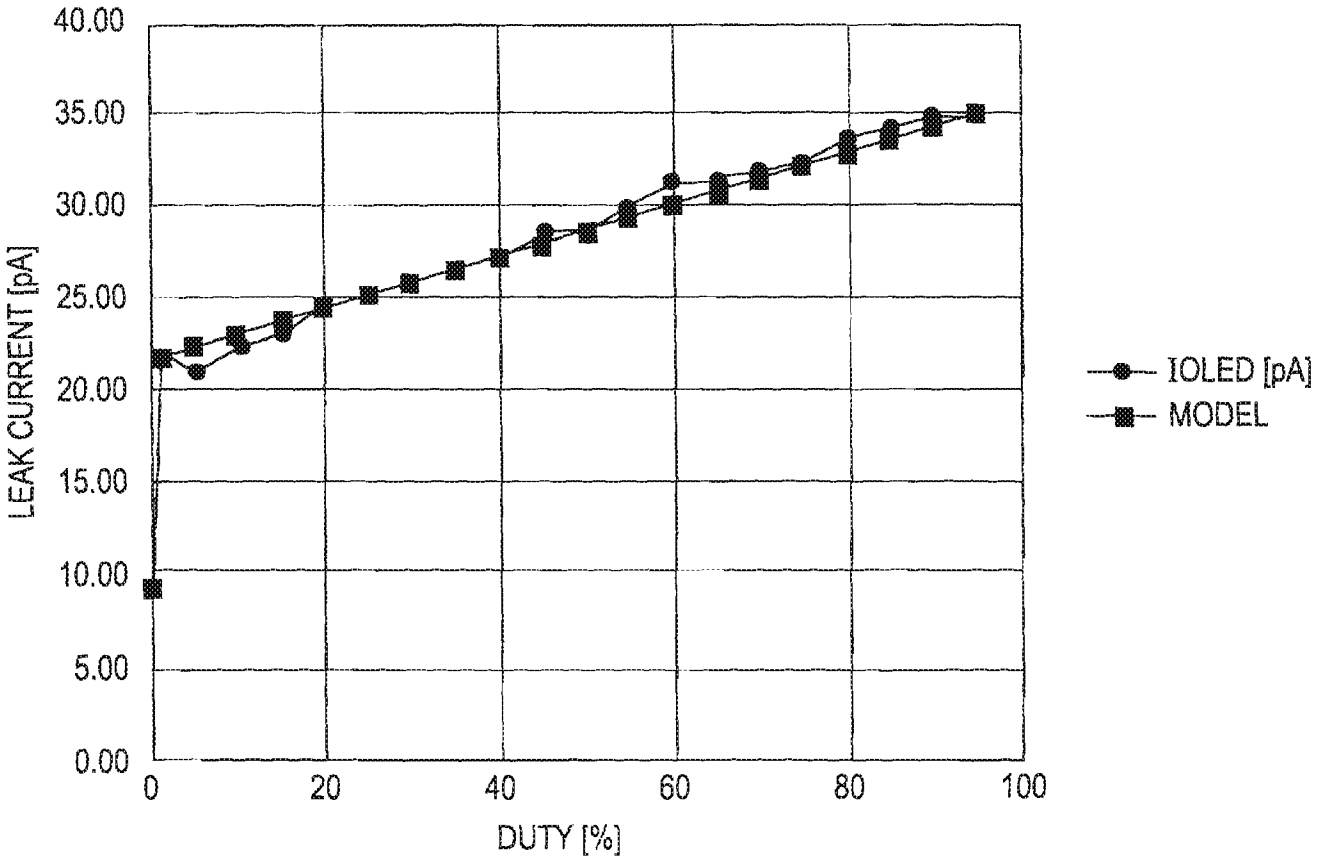
FIG. 15 is a view illustrating the dependency of a leak current with respect to a duty, specifically, a view illustrating a result, which is obtained by executing computer simulation based on evaluation expression for a leak current, and an actual measurement value of the leak current flowing through a light-emitting element, the result and the actual measurement value overlapping each other.

FIG. 15 is a view illustrating the dependency of a leak current with respect to a duty. Specifically, FIG. 15 illustrates a result, which is obtained by executing computer simulation based on an evaluation expression for a leak current, and an actual measurement value of the leak current flowing through a light-emitting element, the result and the actual measurement value overlapping each other. In addition, a duty is a ratio of an emission period of a light-emitting element to a 1 V period, as described above.

In FIG. 15, a characteristic line obtained by plotting black rectangles is a characteristic line based on a simulation model, and a characteristic line obtained by plotting black circles indicates an actual measurement value of a leak current flowing through a light-emitting element. As shown in FIG. 1D, both characteristic lines almost match each other. That is, it can be seen that the leak current model based on the above expression 1 reflects the actual leak current value with high precision.

Here, it is necessary to consider the third leak current (coupling current) that has not been considered in the related art. The coupling current is instantaneous but a peak current value thereof is large. Accordingly, an increase in black level (decrease in contrast) occurring due to instantaneous emission of a light-emitting element, which is caused by the coupling current, is easily registered by the human eye. This is directly associated with deterioration of the quality of a display image.

Therefore, in the embodiments of the invention, this coupling current is reduced by improving a circuit (that is, by intentionally lowering the current drive capability associated with a second scanning line such that the voltage change at the time of rising/failing of the emission control signal GEL becomes small), thereby suppressing the decrease in contrast due to the increase in black level.

Next, embodiments of the invention will be described with reference to the accompanying drawings.

First Embodiment

Figure 1:
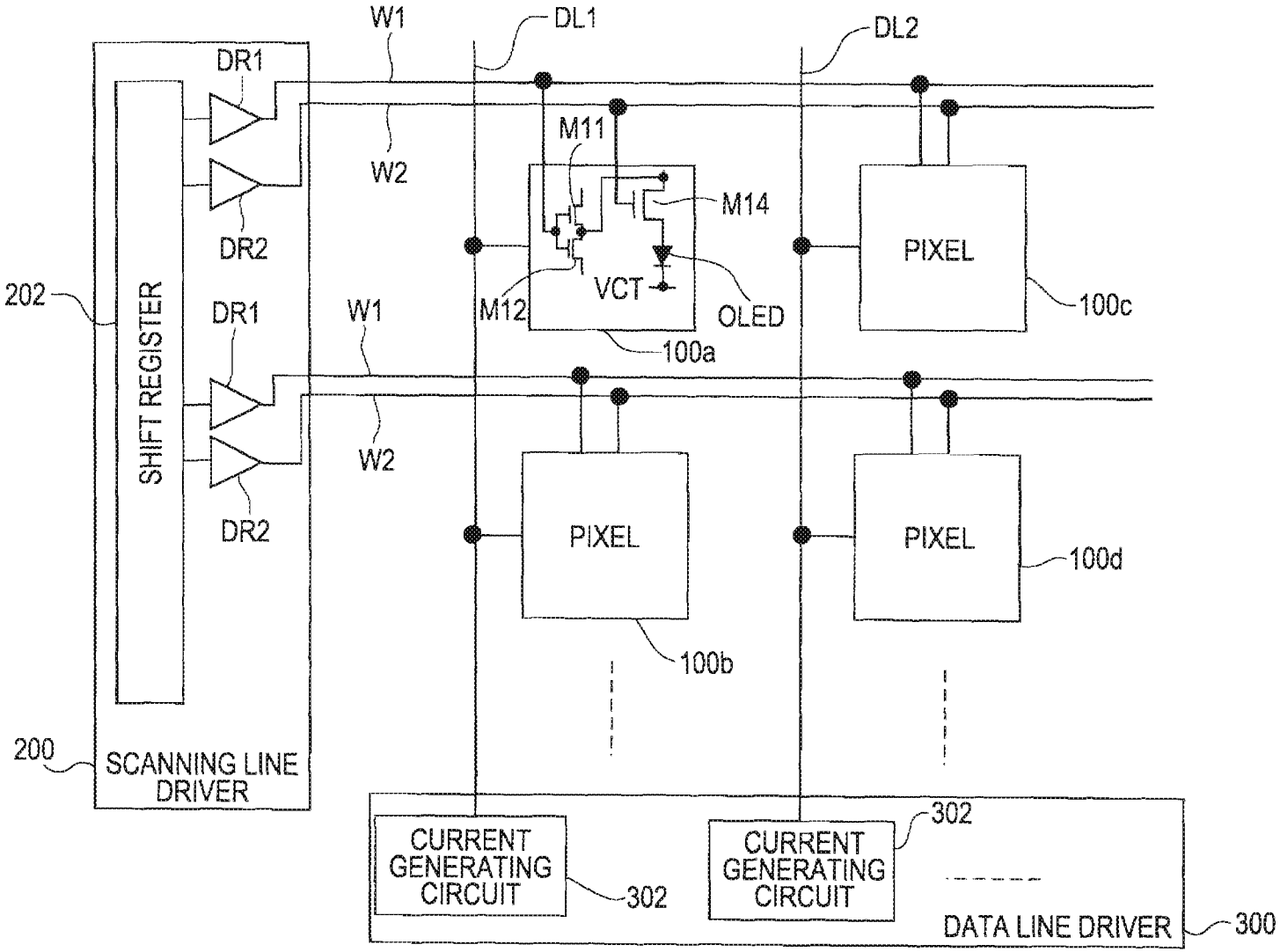
FIG. 1 is a circuit diagram illustrating the overall configuration of an example (organic EL panel based on a current programming method) of an active-matrix-type light-emitting device according to an embodiment of the invention.

FIG. 1 is a circuit diagram illustrating the overall configuration of an example (organic EL panel based on a current programming method) of an active-matrix-type light-emitting device according to an embodiment of the invention.

As shown in the drawing, the active-matrix-type light-emitting device of FIG. 1 includes active-matrix-type pixels (pixel circuits) 100*a* to 100*d*, a scanning line driver (scanning line driving circuit) 200, a data line driver (data line driving circuit) 300, first and second scanning lines W1 and W2, and data lines DL1 and DL2.

Each of the pixels (pixel circuits) 103*a* to 100*d* includes NMOSTFTs M11 and M12, which are driven through the first scanning sine W1 and serve as control transistors, an emission control transistor M14 driven through the second scanning line W2, and an organic EL element OLED.

In addition, the scanning line driver 200 includes a shift register 202, an output buffer DR1 for driving the first scanning line W1, and an output buffer DR2 for driving the second scanning line W2.

In addition, the data line driver 300 includes a current generating circuit 302 that performs current driving for the data lines DL1 and DL2.

Figure 2:
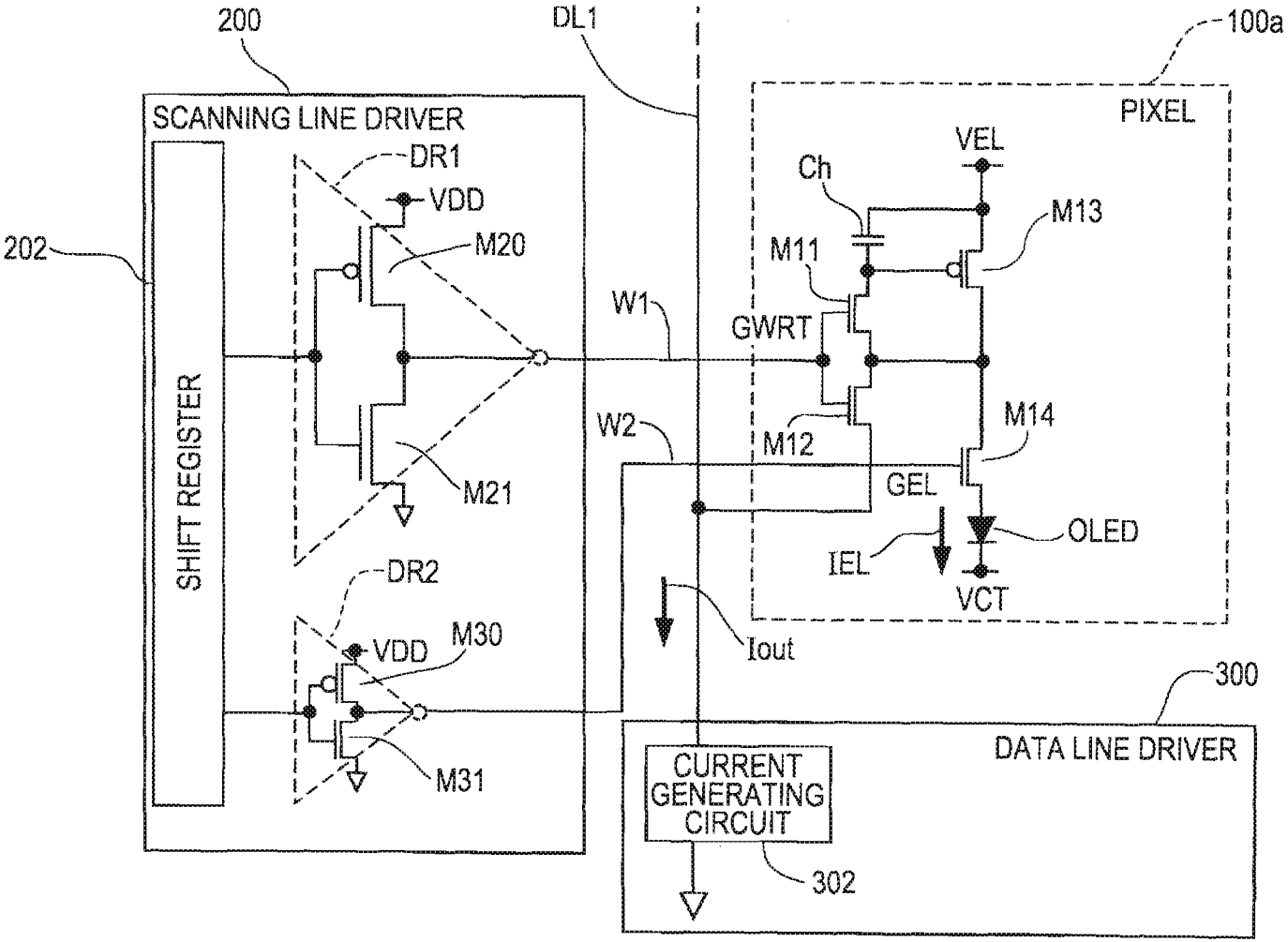
FIG. 2 is a circuit diagram illustrating the specific circuit configuration of a pixel (pixel circuit) and the circuit configuration of an output buffer in a scanning line driver and the transistor size in the output buffer, in the active-matrix-type light-emitting device shown in FIG. 1.

FIG. 2 is a circuit diagram illustrating the specific circuit configuration of a pixel (pixel circuit) and the circuit configuration of an output buffer in the scanning line driver and the transistor size in the output buffer, in the active-matrix-type light-emitting device shown in FIG. 1. Moreover, in FIG. 2, only the pixel 100*a* among the plurality of pixels shown in FIG. 1 is shown.

The pixel (pixel circuit) 100*a* includes: a holding capacitor Ch; the control transistors (switching transistors) M11 and M12 that are provided between the holding capacitor Ch and the data line DL1 in order to control an operation in which data is written into the holding capacitor Ch and an operation in which the written data is held; a driving transistor (PMOSTFT) M13 that generates a driving current (IEL) for making the organic EL element OLED emit light, and the emission control transistor (NMOSTFT) M14. The driving transistor M13, the emission control transistor M14, and the organic EL element OLED are connected in series between pixel power supply voltages VEL and VCT.

In addition, each of the output buffers DR1 and DR2 provided in the scanning line driver 200 is formed using a CMOS inverter. Even though a one-stage inverter is shown in FIG. 2, the invention is not limited thereto. For example, it may be possible to use a plurality of inverters that are connected to each other so as to have odd-numbered stages or even-numbered stages.

Here, it should be noted that a current drive capability associated with the scanning line W2 for driving the emission control transistor M14 is intentionally set to be lower than that associated with the scanning line W1 for driving other control transistors.

That is, the sizes of transistors (PMOSTFT M30 and NMOSTFT M31) included in the output buffer DR2 are set to be smaller than those of transistors (PMOSTFT M20 and NMOSTFT M21) included in the output-buffer DR1. The reason why the output buffer DR2 is show to be smaller than the output buffer DR1 in FIG. 2 is to make such a difference in the sizes of the transistors clear.

Specifically, the gate length L of each of the transistors (PMOSTFT M30 and MOSTFT M31) included in the output buffer DR2 is 10 μm and the gate width W thereof is 100 μm, for example. In contrast, the gate length L of each of the transistors (PMOSTFT M20 and NMOSTFT M21) included in the output buffer DR1 is 10 μm and the gate width W thereof is 400 μm. That is, the channel conductance (W/L) of each transistor included in the output buffer DR2 is about ¼ of that of each transistor included in the output buffer DR1.

Figure 3:
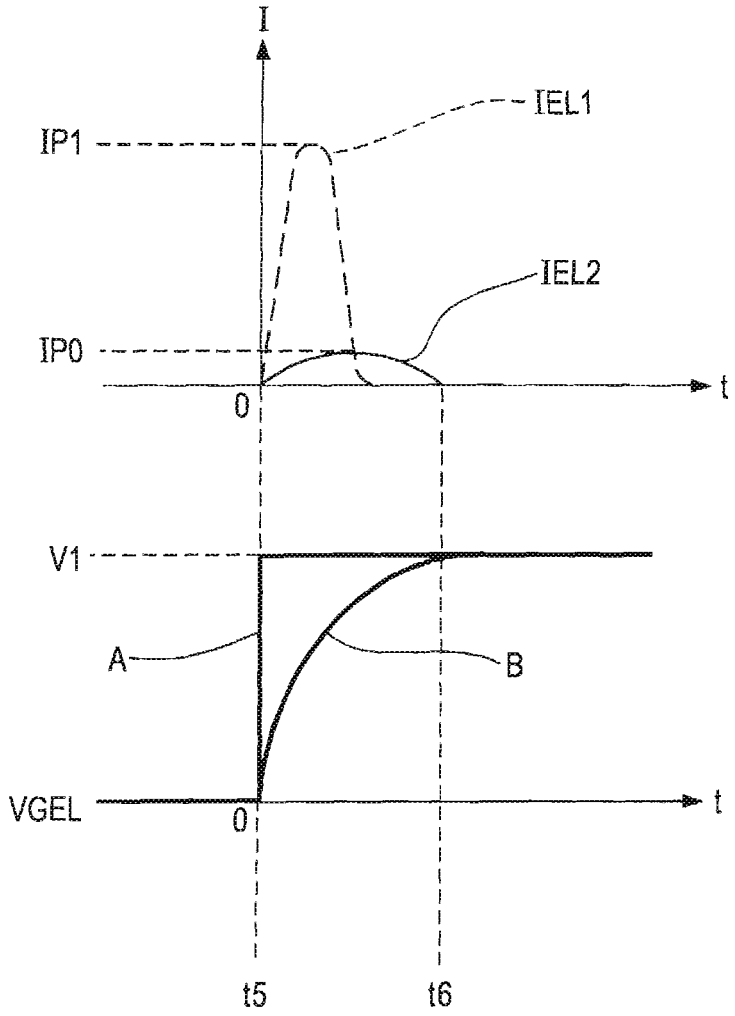
FIG. 3 is a view for explaining an effect obtained due to reduction of a coupling current in the circuit shown in FIG. 2.

FIG. 3 is a view for explaining an effect obtained due to reduction of a coupling current in the circuit shown in FIG. 2. Two types of rising waveform of the emission control signal GEL, which controls ON/OFF of the emission control transistor M14, are shown in a lower part of FIG. 3. A steep rising waveform A is a waveform obtained through usual driving. In contrast, a waveform B that rises with a predetermined time constant (in which a change in voltage is gentle) is a waveform obtained in the case of driving the scanning line W2 using the output buffer DR2 whose current drive capability is set low as shown in FIG. 2.

In an upper part of FIG. 3, a coupling current flowing through the parasitic capacitance Cgs (refer to FIG. 14A) between the gate and the source of the emission control transistor M14 at the time of black display is shown. A coupling current (IEL1; indicated by a dotted line in the drawing) is a coupling current corresponding to the rising waveform A of the emission control signal GEL and the peak value of the coupling current IEL1 is IP1, which is quite large.

On the other hand, a coupling current (IEL2: indicated by a solid line in the drawing) is a coupling current corresponding to the rising waveform B of the emission control signal GEL and the peak value IP0 of the coupling current IEL2 is quite large compared with the peak value IP1 of the coupling current IEL1.

The coupling current TEL1 is instantaneous but the peak current value IP1 thereof is large. Accordingly, the increase in black level (decrease in contrast) occurring due to instantaneous emission of a light-emitting element, which is caused by the coupling current, is easily registered by the human eye. This is directly associated with deterioration of the quality of a display image.

On the other hand, since the coupling current IEL2 is distributed in the time axis direction, the peak value IP0 is low. Accordingly, the increase in black level is very small, which is hardly sensed by the human eye.

Thus, it is possible to reduce the instantaneous coupling current, the peak value of which is high, by intentionally lowering the current drive capability associated with the second scanning line such that the voltage change at the time of rising/falling of the emission control signal GEL becomes small). As a result, it is possible to suppress the contrast from decreasing due to the increase in black level.

In addition, the decrease in the current drive capability associated with the second scanning line may cause a small driving delay; however, no particular problem occurs if driving timing is set appropriately. That is, the emission control transistor M14 is a transistor which performs an ON/OFF operation only during a predetermined period of a 1 V period and whose driving frequency is low. On the other hand, the other control transistors M11 and M12 are transistors which perform an ON/OFF operation at least once during a 1 H period and whose driving frequency is high. In addition, the size of the emission control transistor is larger than that of the other TFTs. That is, a high-speed switching performance is not requested to the emission control transistor M14 from the first unlike the other control transistors M11 and M12. In addition, a predetermined timing margin is allowed in driving the emission control transistor M14. Therefore, even if the a small driving delay occurs due to degradation of the drive capability of the second scanning line W2, no problem occurs when adjusting the driving timing using the timing margin.

As for the drive capability of the driver circuit DR2 that drives the second scanning line, it is preferable to set the drive capability of the driver circuit such that $C_{W2}\times\Delta V\div I_{sat}=T_{1H}$ is satisfied assuming that a saturation current of a TFT included in the buffer circuit is $I_{sat}$, the wiring capacity of the second scanning line is $C_{W2}$, and the voltage amplitude of a scanning line is ΔV. Furthermore, since a coupling current generated at the time of an increase in the level of second scanning line signal causes black float, a circuit may be configured such that the drive capability of only a Pch-TFT is restricted.

In additions as a light-emitting device is highly integrated, a light-emitting element and an emission control transistor are more closely disposed on a substrate. In this case, when an emission control pulse leaks toward the light-emitting element, the pulse current flows to the light-emitting element without being attenuated, and accordingly, the black float becomes noticeable. Even in the case of the light-emitting device that is highly integrated, the invention is advantageous since an appropriate driving circuit can be provided therefor.

Moreover, even in the case when two transistors having the same size are connected in parallel to each other, the transistor size substantially changes assuming the two transistors to be one transistor.

Figure 4:
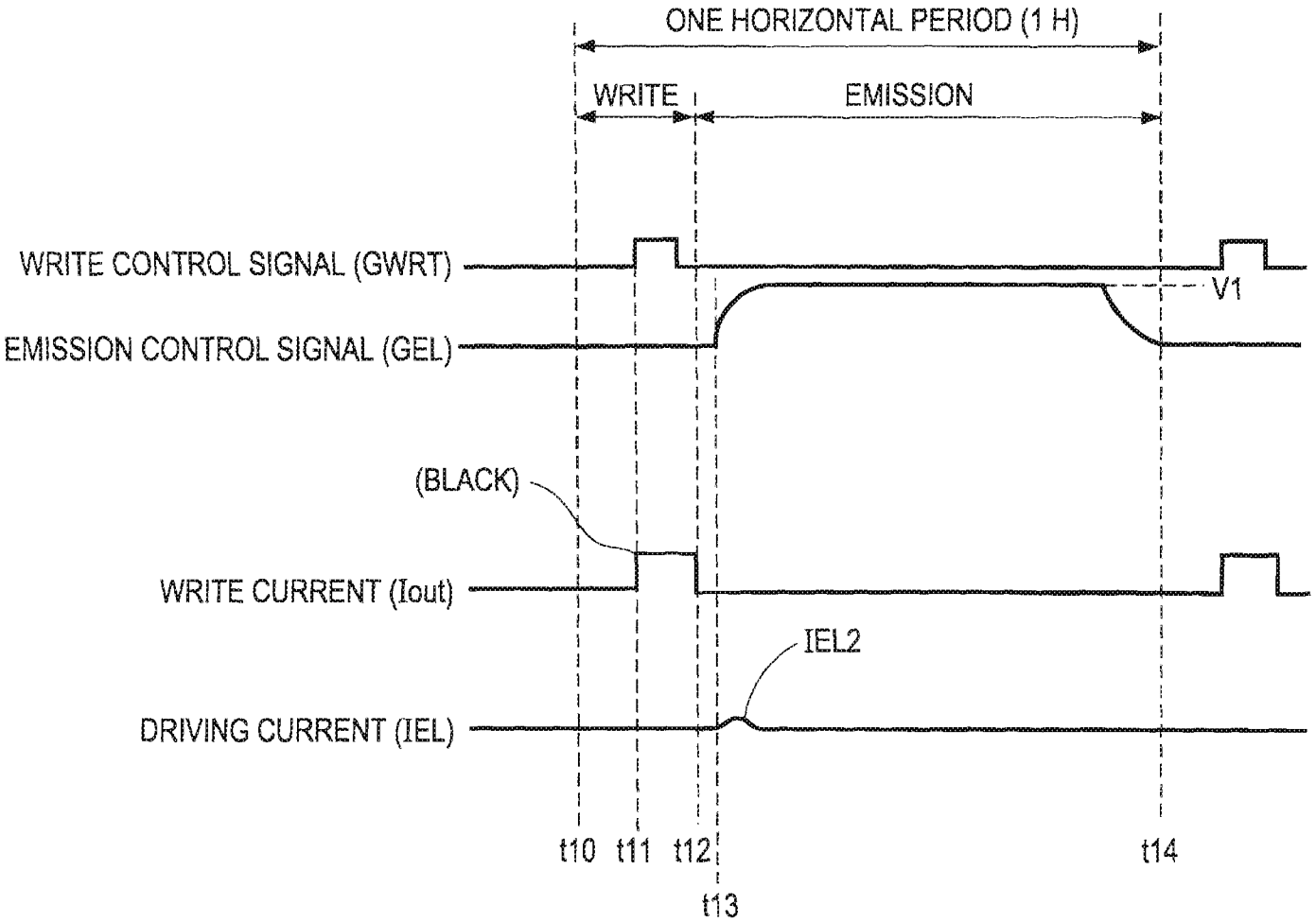
FIG. 4 is a timing chart for explaining an operation of the pixel circuit shown in FIG. 2.

Next, a specific operation of the pixel circuit shown in FIG. 2 will be described. FIG. 4 is a timing chart for explaining the operation of the pixel circuit shown in FIG. 2. In FIG. 4, a period from time t10 to time t12 is a write period (period for which electric charges of the holding capacitor Ch are adjusted by a current Iout), and a period from time t12 to time t14 is an emission period. During the emission period, a voltage between both ends of the holding capacitor Ch is held, a driving current IEL is generated by the driving transistor M13 (however, the driving transistor holds an OFF state in black display), and the driving current IEL is supplied to the organic EL element OLED through the emission control transistor M14 that is in the ON state.

Referring to FIG. 4, a scan and write control signal GWRT transmitted through the first scanning line W1 changes to a high level at time t11. As a result, NMOSTFTs M11 and M12 are turned on at the same time, and thus an end of the holding capacitor Ch is electrically connected to the data line DL1. At the same time, electric charges held in the holding capacitor Ch are adjusted by means of the current (write current) Iout generated by the current generating circuit 302. Thus, an emission gray scale is programmed. Here, a black gray scale is programmed since black display is assumed.

Then, at time t13, the level of the emission control signal GEL transmitted through the word line W2 gently increases with a predetermined time constant. The driving current IEL2 flowing at this time includes only a coupling current component and the coupling current is distributed in the time axis direction, and accordingly, a peak value thereof is very small. For this reason, the increase (grade of black float) in black level does not cause a problem.

At time t14, the emission period ends. The timing of the emission control signal GEL is adjusted such that the mission control signal GEL changes from a high level to a low level slightly before time t14.

Next, the sectional structure of a pixel and a lighting method in an active-matrix-type organic EL panel will be described.

Figure 5A:
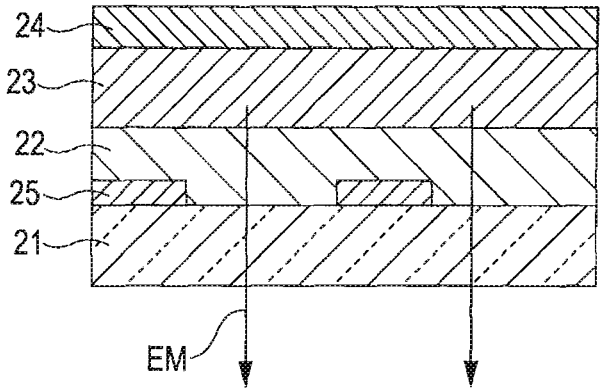
FIG. 5A is a cross-sectional view illustrating a device for explaining the sectional structure of a pixel and a lighting method in an active-matrix-type organic EL panel, which shows a bottom-emission-type structure.

FIGS. 5A and 55 are cross-sectional views illustrating a device for explaining the sectional structure of a pixel and a lighting method in an active-matrix-type organic EL panel.

Figure 5B:
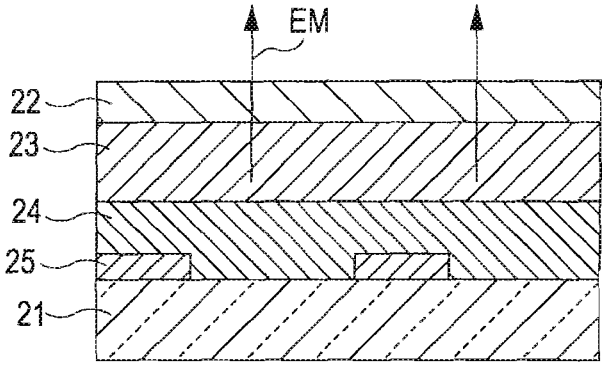
FIG. 5B is a cross-sectional view illustrating a device for explaining the sectional structure of a pixel and a lighting method in an active-matrix-type organic EL panel which shows a top-emission-type structure.

Specifically, FIG. 5A is a view illustrating a bottom-emission-type structure, and FIG. 5B is a view illustrating a top-emission-type structure.

In FIGS. 5A and 55, reference numeral 21 denotes a transparent glass substrate, reference numeral 22 denotes a transparent electrode (ITO), reference numeral 23 is an organic light-emitting layer (including a case in which an organic electron transport layer or an organic hole transport layer is formed by lamination), reference numeral 24 is a metal electrode made of aluminum or the like, and reference numeral 25 is a TFT (polysilicon thin-film transistor) circuit.

As a polysilicon thin-film transistor included in the TFT circuit 25, it is preferable to use a so-called "low-temperature polysilicon thin-film transistor" that is formed by suppressing the highest temperature at the time of manufacture so that it is 600° C. or less.

The organic light-emitting layer 23 may be formed using an ink jet type printing method, for example. In addition, the transparent electrode 22 and the metal electrode 24 may be formed using a sputtering method, for example.

In the bottom-emission-type structure shown in FIG. 5A, light EM is emitted through the substrate 21. In contrast, in the top-emission-type structure shown in FIG. 5B, the light EM is emitted in the direction of a side opposite the substrate 21.

In the case of the bottom-emission-type structure shown in FIG. 5A, if the occupation area of the TFT circuit 25 increases as the number of elements included in a pixel circuit increases, a case may occur in which the aperture ratio of a light-emitting portion decreases by the increase in the occupation area and thus the emission brightness decreases. However, in the case of the top-emission-type structure shown in FIG. 5B, the aperture ratio does not decrease even if the occupation area of the TFT circuit 25 increases. In the case when increase in the number of elements of a pixel circuit is an issue, it can be said that it is preferable to adopt the top-emission-type structure shown in FIG. 5B. However, without being limited thereto, the bottom-emission-type structure may also be adopted if small decrease in the aperture ratio does not cause a problem.

Second Embodiment

Figure 6:
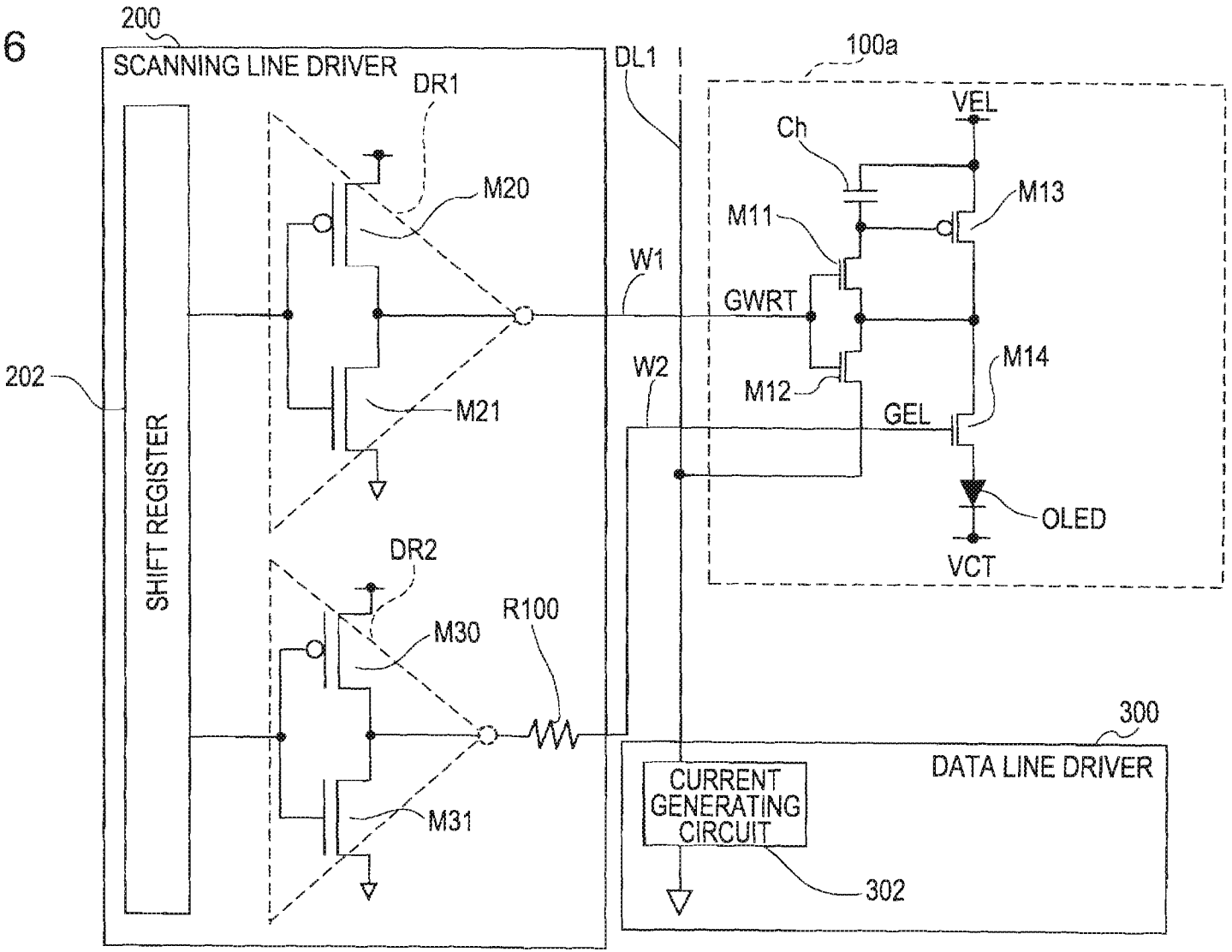
FIG. 6 is a circuit diagram illustrating the circuit configuration of an example (example in which a current drive capability is reduced by connecting a current restricting resistor to an output end of an output buffer that drives a second scanning line) of an active-matrix-type light-emitting device according to another embodiment of the invention.

FIG. 6 is a circuit diagram illustrating the circuit configuration of an example (example in which the current drive capability is reduced by connecting a current restricting resistor to an output end of an output buffer that drives a second scanning line) of an active-matrix-type light-emitting device according to another embodiment of the invention. In FIG. 6, the same components as in FIG. 2 are denoted by the same reference numerals.

The circuit configuration of the active-matrix-type light-emitting device shown in FIG. 6 is almost the same as the circuit configuration of the circuit shown in FIG. 2. However, in FIG. 6, the sizes (channel conductance W/L) of transistors M20, M21, M30, and M31 included in two output buffers DR1 and DR2 are equal to each other and a resistor R100 is connected to an output end of the output buffer DR2.

The resistor R100 serves as a current restricting resistor and also serves as a component of a time constant circuit based on "CR". The current drive capability associated with the second scanning line W2 can be optimized by properly adjusting the resistance of the resistor R100.

By providing the resistor R100, it is possible to substantially weaken the current drive capability of the output buffer DR2. Accordingly, a rising waveform of the emission control signal GEL when driving the emission control transistor M14 with the second scanning line W2 connected to the output end of the output buffer DR2 becomes gentle. As a result, since a coupling current is reduced, the increase in black level is suppressed.

In FIG. 6, the sizes of transistors included in the two output buffers DR1 and DR2 are set to be equal but not limited thereto. For example the size of a transistor included in the output buffer DR2 may be set to be relatively small and the resistor R100 may be connected to the transistor included in the output buffer DR2 to make a fine adjustment on the current drive capability associated with the scanning line W2.

As for a resistance R of a resistor that is connected, it is preferable to set the resistance R such that $C_{W2} \times R = T_{1H}$ is satisfied assuming that one horizontal period is $T_{1H}$ and the wiring capacitance of the second scanning line is $C_{W2}$.

Third Embodiment

Figure 7:
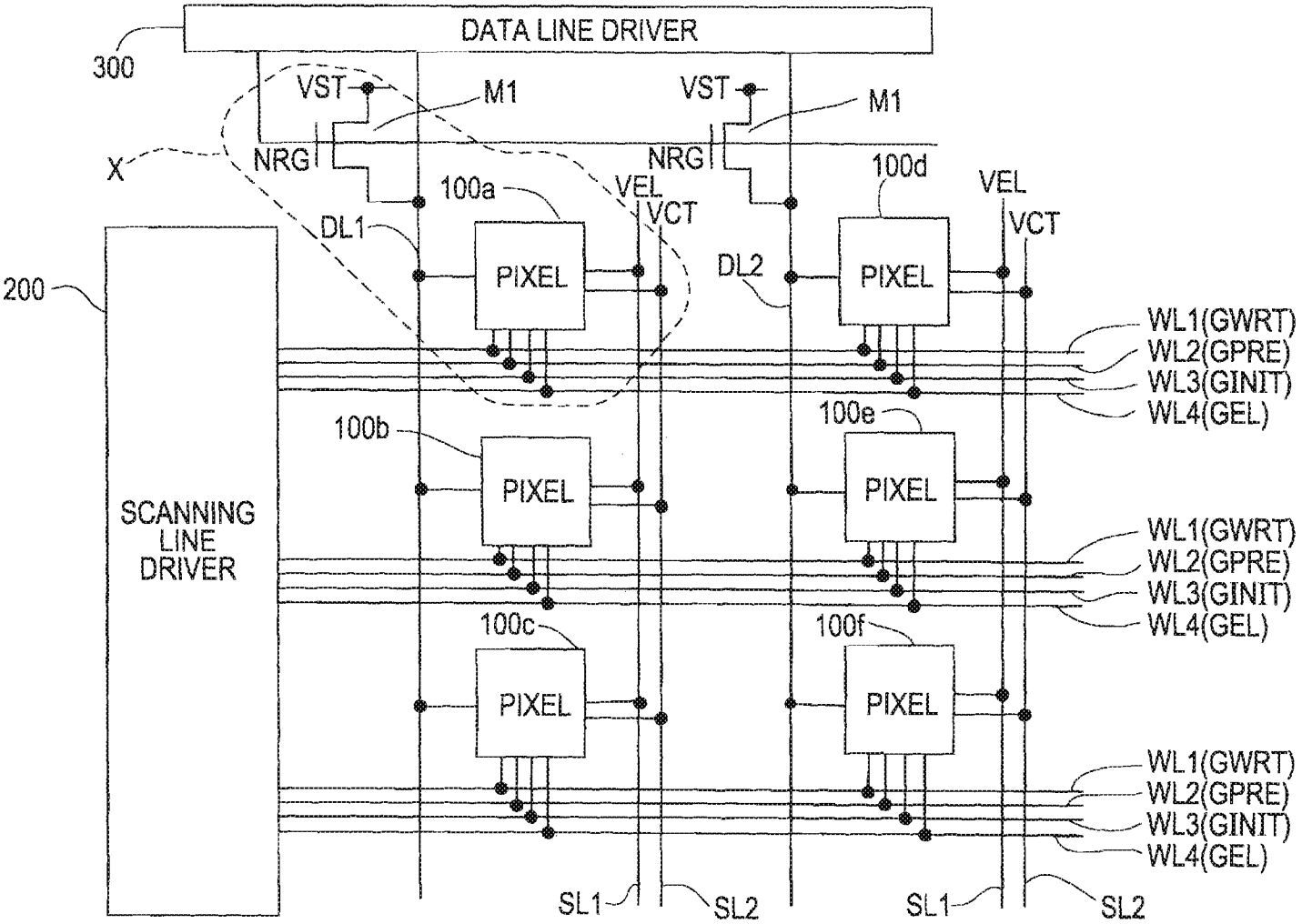
FIG. 7 is a block diagram illustrating the overall configuration of an example of an active-matrix-type light-emitting device according to still another embodiment of the invention.

FIG. 7 is a block diagram Illustrating the overall configuration of an example of an active-matrix-type light-emitting device according to still another embodiment of the invention. In the following description, it is assumed that the active-matrix-type light-emitting device is an organic EL panel.

In an organic EL display panel shown in FIG. 7, an organic EL element is used as a light-emitting element and a polysilicon thin-film transistor (TFT) is used as an active element. In the following description the "polysilicon thin-film transistor" may be expressed as "thin-film transistor", a "TFT", or simply "transistor".

In addition, an organic EL element is formed on a substrate formed with a thin-film transistor (TFT). In addition, the organic EL element has a structure in which an organic layer including a light-emitting layer is provided between two electrodes, and a top-emission-type structure is preferably adopted in the embodiment of the invention.

The active-matrix-type light-emitting device shown in FIG. 7 includes: pixels (pixel circuits) 100*a* to 100*f* which are arranged in a matrix and each of which has an organic EL element; data lines DL1 and DL2; scanning lines WL1 to WL4, a plurality of scanning lines WL1 to WL4 being set as a group; a scanning line driver 200; a data line driver 300 having a data line precharge circuit M1, and a pixel power supply wiring lines SL1 and SL2.

The pixel precharge circuit M1 is configured to include an N-type and insulation-gate-type TFT (MOSTFT) having sufficient current drive capability. The TFT M1 is ON/OFF controlled by a data line precharge control signal NRG. A drain of the TFT M1 is connected to a data line precharge voltage (also simply referred to as a precharge voltage) VST and a source of the TFT M1 is connected to the data lines DL1 and DL2. In addition, the data line precharge voltage VST is set to 10 V or more, for example.

The scanning line WL1 serves to control ON/OFF of a write transistor (not shown in FIG. 7) within each of the pixels 100*a* to 100*f* on the basis of a write control signal GWRT.

In addition, the scanning line WL2 serves to control ON/OFF of a pixel precharge transistor (not show in FIG. 1) within each of the pixels 100*a* to 100*f* on the basis of a pixel precharge control signal GPRE.

In addition, the scanning line WL3 serves to control a compensation transistor (not shown in FIG. 7) within each of the pixels 100*a* to 100*f* on the basis of a compensation control signal GINIT.

In addition, the scanning line WL4 serves to control an emission control transistor (not shorten in FIG. 1) within each of the pixels 100*a* to 100*f* on the basis of the emission control signal GEL.

The scanning line driver 200 periodically drives the four scanning lines WL1 to WL4 at predetermined timing.

In addition, the pixel power supply wiring line SL1 serves to supply to each pixel a high-level supply voltage Ve1 (for example, 13 V) for making an organic EL element emit light. In addition, the pixel power supply wiring line SL2 serves to supply a low-level supply voltage VST (for example, a ground potential) to each pixel.

Figure 8:
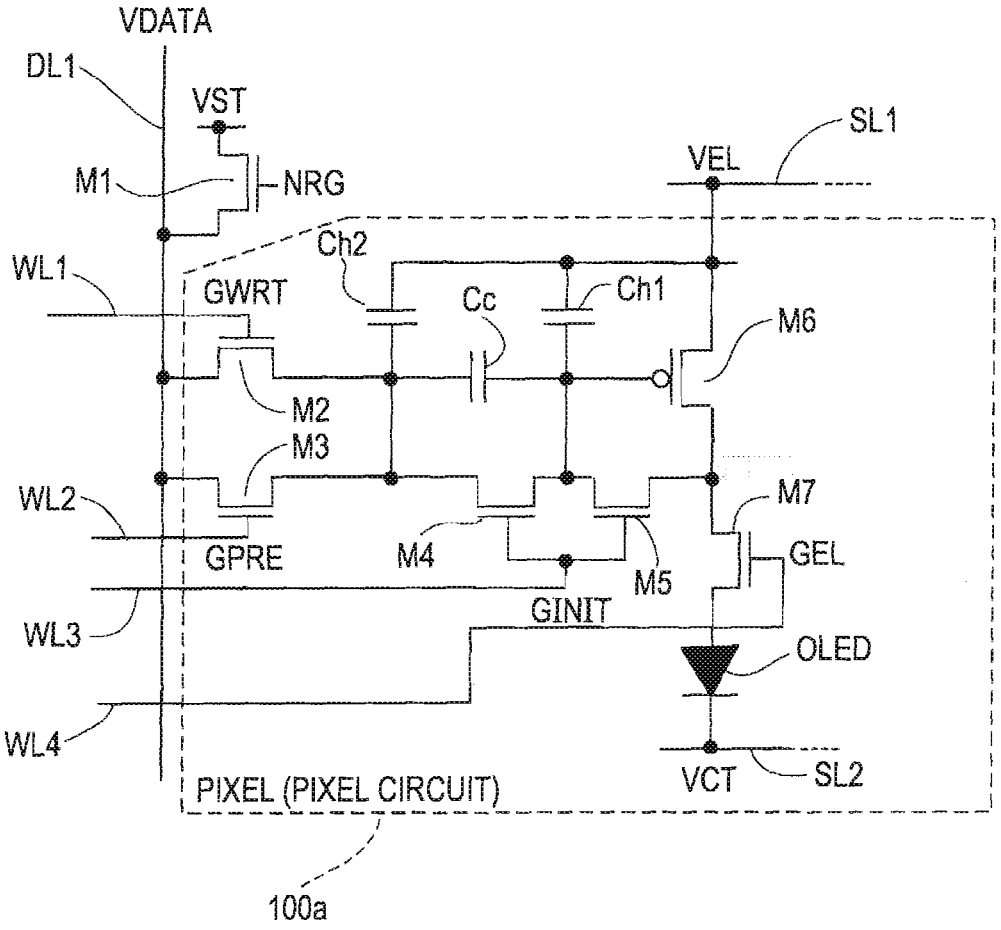
FIG. 8 is a circuit diagram illustrating an example of the specific circuit configuration of main components ("X" portion surrounded by a dotted line in FIG. 7) of the organic EL display panel shown in FIG. 7.

FIG. 8 is a circuit diagram illustrating an example of the specific circuit configuration of main components ("X" portion surrounded by a dotted line in FIG. 7) of the organic EL display panel shown in FIG. 7.

As shown in FIG. 8, the pixel (pixel circuit) 100*a* includes a write transistor M2, a coupling capacitor Cc, first and second holding capacitors ch1 and ch2, a driving transistor M6, pixel precharge transistors M3 and M4, compensation transistors M4 and M5, an emission control transistor M7, and an organic EL element OLED serving as a light-emitting element.

The write transistor M2 is an N-type TFT. An end of the write transistor M2 is connected to a data line DLL, the other end of the write transistor M2 is connected to an end of the coupling capacitor Cc, and a gate of the write transistor M2 is connected to the scanning line WL1. The write transistor M2 is turned on by the write control signal GWRT at the time of writing data.

The driving transistor M6 is a P-type TFT. An end of the driving transistor M6 is connected to the pixel power supply voltage VEL and a gate of the driving transistor M6 is connected to the other end of the coupling capacitor Cc. The driving transistor M6 is turned on during an emission period of the organic EL element OELD and supplies a driving current to the organic EL element OELD.

The coupling capacitor Cc is provided between the other end of the write transistor M2 and the gate of the driving transistor M6. During a data writing period, a changed component (AC component) of a write voltage is transmitted to the gate of the driving transistor M6 through the coupling capacitor Cc.

An end of the first holding capacitor ch1 is connected to a common connection point between the driving transistor M6 and the coupling capacitor Cc and the other end of the first holding capacitor ch1 is connected to the pixel power supply voltage VEL. Here, the other end of the first holding capacitor ch1 may also be connected to a ground GND instead of the pixel power supply voltage VEL. That is, the other end of the first holding capacitor ch1 is connected to a stable DC potential.

The first holding capacitor ch1 holds written data (write voltage) such that emission of the organic EL element OLED can be maintained even for a non-selection period. Moreover, the first holding capacitor ch1 also has a function of making a gate voltage of the driving transistor M6 stabilized.

An end of the second holding capacitor ch2 is connected to a common connection point between the write transistor M2 and the coupling capacitor Cc and the other end of the second holding capacitor ch2 is connected to the pixel power supply voltage VEL. Here, the other end of the second holding capacitor ch2 may also be connected to the ground GND instead of the pixel power supply voltage VEL. That is, the other end of the second holding capacitor ch2 is connected to a stable DC potential.

The second holding capacitor ch2 is provided to suppress an electric potential of an end of a coupling capacitor from changing due to crosstalk between the data line DL1 and a source-drain capacitance (parasitic capacitance) of the write transistor M2 or crosstalk caused by electrical coupling between other data lines and the source-drain capacitance (parasitic capacitance) of the write transistor M2. By providing the second holding capacitor ch2, an electric potential or the gate of the driving transistor M6 becomes stabilized.

Furthermore, an end of the pixel precharge transistor M3 is connected to the data line DL1 and a gate of the pixel precharge transistor M3 is connected to the scanning line WL2. The pixel precharge transistor M3 is turned on by the pixel precharge control signal GPRE during a data line precharge period (period for which the data line precharge circuit M1 is in an ON state), thereby precharging (initializing) the coupling capacitor Cc. As a result, an electric potential between both ends of the coupling capacitor Cc increases up to a level close to a target convergence voltage (this will be explained later with reference to FIG. 3. Moreover, the pixel precharge transistor M3 is turned off after the data line precharge period ends, such that a pixel (specifically, the coupling capacitor Cc) is electrically separated from the data line DL1.

Furthermore, since the compensation transistor M4 also contributes to precharging (initializing) the coupling capacitor Cc, it can be said that the compensation transistor M4 has a function of a pixel precharge transistor.

In addition, gates of the compensation transistors M4 and M5 are connected to the scanning line WL3 and are turned on by the compensation control signal GINIT during a compensation period of a threshold voltage. The compensation transistor M4 and M5 serve to form a current path for causing a DC potential of an end of the coupling capacitor Cc facing the write transistor M2 to converge to a target value (voltage value reflecting a threshold voltage of the driving transistor M6, that is, a compensation value (correction value) applied to written data). That is, the compensation transistor M4 and M5 serve to generate the compensation value (correction value) of a gate voltage in order to absorb variation of the threshold voltage of the driving transistor M6. For this reason, the transistors M4 and M5 are called the "compensation transistor".

Moreover, as described above, the compensation transistor M4 also has a function of forming a current path for precharge (initialization) of the coupling capacitor Cc.

In addition, the emission control transistor M7 is provided between the driving transistor M6 and the organic EL element OLED, and a gate of the emission control transistor M7 is connected to the scanning line WL4. The emission control transistor M7 is turned on by the emission control signal GEL during the emission period of the organic EL element OELD, such that a driving current is supplied to the organic EL element OLED. As a result, the organic EL element emits light. Since the emission control transistor M7 is provided, the pixel (pixel circuit) 100*a* serves as an active-matrix-type pixel (pixel circuit).

Since the current drive capability associated with the scanning line WL4 for driving the emission control transistor M7 is set to be lower than those associated with the scanning lines WL1 to WL3 for driving other transistors in the same manner as in the embodiment described earlier, the increase in black level occurring due to a coupling current is suppressed.

Figure 9:
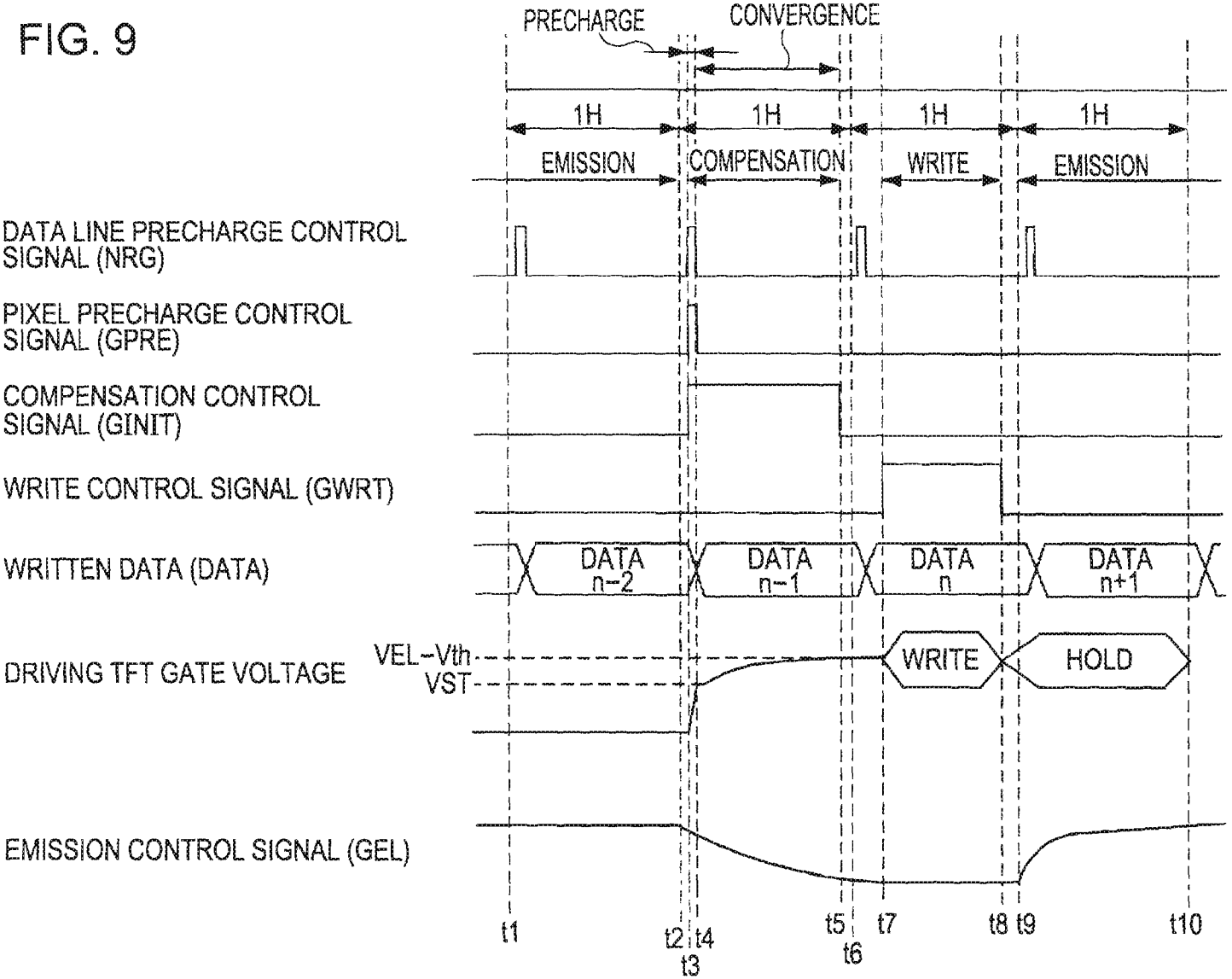
FIG. 9 is a view for explaining the operation timing of a pixel (pixel circuit) shown in FIG. 8 and the change of a gate voltage waveform of a driving transistor.

Next, an operation of the pixel (pixel circuit) shown in FIG. 8 will be described. FIG. 9 is a view for explaining the operation timing of the pixel (pixel circuit) shown in FIG. 8 and the change of a gate voltage waveform of a driving transistor.

In FIG. 8, a period from time t1 to time t2, a period from time t2 to time t6, a period from time t6 to time t9, a period from time t9 to time t10 are equivalent to one horizontal synchronization period (expressed as 1 H in the drawing).

In FIG. 8, a period before time t2 and after time t9 is an "emission period" for which the organic EL element OLED emits light. In addition, a period from time t3 to time t5 is a "compensation period" for compensating the variation of a threshold voltage of the driving transistor M6. In addition, a period from time t7 to time t8 is a "write period" for which data from the data line DL1 is written through a write transistor and a coupling capacitor.

During an extremely short period immediately after the start each horizontal synchronization period 1H, the data line precharge signal is at a high level. As a result, the data line precharge circuit M1 is turned on, which causes a data line to be precharged.

In connection with the pixel 100*a* shown in FIG. 8, the pixel precharge control signal GPRE is at a high level during a period from time t3 to t4 (that is, the pixel precharge control signal GPRE changes to a high level in synchronization with a data line precharge period). During the period for which the pixel precharge control signal GPRE is at a high level, the pixel precharge transistors M3 is turned on, such that the pixel 100*a* is connected to the data line DL1 through the pixel precharge transistor M3. Accordingly, precharge (initialization) of the coupling capacitor Cc is performed. In this case, the pixel precharge transistor M3 is in the ON state only for the precharge period of the data line DL1 and is turned off as soon as the precharge period ends.

In addition, the compensation control signal GINIT is at a high level during a period (compensation period) from time t3 to time t5. As a result, the compensation transistors M4 and M5 are turned on and the driving transistor M6 is in a diode connection state, such that a current path that connects an anode of the diode and each of both ends of the coupling capacitor Cc is formed. Moreover, an electric potential between both ends of the coupling capacitor Cc converges to a voltage value (VEL−Vth) reflecting a threshold voltage Vth of the driving transistor M6.

The write control signal GWRT is at a high level during a period from time t7 to time t8, such that the write transistor M2 is turned on. N-th data DATAn from the data line DL1 is written into the pixel 100*a*. Accordingly, the driving transistor M6 is turned on. Furthermore, since the first holding capacitor ch1 is provided, the written data (write voltage) is held even for a non-selection period of the pixel 100*a*.

The emission control signal GEL changes to a high level at time t9 after writing of the data is completed, such that the emission control transistor M7 is turned on. Then, the driving current from the driving transistor M6 is supplied to the organic EL element OLED, such that the organic EL element OLED emits light.

In a lower part of FIG. 9, the change of the gate voltage of the driving transistor M6 is shown. At time t3, the pixel precharge signal GPRE changes to a high level, and accordingly, the pixel precharge transistors M3 is turned on. At the same time, since the compensation control signal GINIT also changes to a high-level at time t3, the compensation transistor M4 is also turned on at time t3. Thus, the data line DL1 and each of the both ends of the coupling capacitor Cc are electrically connected to each other. Accordingly, during the period from time t3 to time t4, the coupling capacitor Cc is quickly precharged by the precharge current of the data line DL1. As a result, the gate potential of the driving transistor M6 quickly rises up to the precharge voltage VST (voltage applied to an end of the data line precharge circuit M1) of the data line. Since the current drive capability of the data line precharge circuit M1 is high, the coupling capacitor Cc may be precharged in high speed.

At time t4, the pixel precharge transistors M3 is turned off, such that the pixel 100*a* is electrically separated from the data line DL1. At this time, since the compensation transistor M5 is turned on, a gate and a drain of the driving transistor is short-circuited, resulting in the diode connection state.

Therefore, during a period from time t4 to time t7, a forward current from the driving transistor M6 that is in the diode connection state is directly supplied to an end of the coupling capacitor Cc facing the driving transistor M6, and the forward current is also supplied to the other end of the coupling capacitor Cc facing the write transistor M2 through the compensation transistor M4 that is in the ON state. Then, the coupling capacitor Cc is electrically charged and a voltage between both ends of the coupling capacitor Cc rises as time goes by. As a result, the voltage between both the ends of the coupling capacitor Cc converges to an electric potential (VEL−Vth) reflecting the threshold voltage Vth of the driving transistor M6. Since the gate potential of the driving transistor M6 becomes the potential VST close to the target convergence value, convergence to (VEL−Vth) is advanced. The converged voltage value (VEL−Vth) is a compensation correction voltage value for compensating (correcting) a regular write voltage.

Even though it takes a predetermined amount of time to cause the gate voltage of the driving transistor M6 to converge to (VEL−Vth), a pixel is electrically separated from the data line DL1 after the pixel precharge period in the embodiment of the invention. Accordingly, writing of data into other pixels through the data line DL1 and a compensation operation inside the pixel 100*a* can be performed in parallel and the compensation operation can be performed over a plurality of horizontal synchronization periods. As a result, a sufficient compensation period can be secured.

Then, data is written at time t7 and the written data is held even after time t8.

As shown in a lowest part of FIG. 9, the electric potential of the emission control signal GEL gently changes during a period from time t2 to time t7, that is, over one horizontal synchronization period (1 H) or more. As is apparent from FIG. 9, an OFF period of the emission control signal GEL is a period corresponding to 2 H from time t2 to time t9, which is a sufficiently long period of time. Paying attention to this point, a period of time from the start of change of an electric potential of the scanning line to the convergence is set to be 1 H or more by making the current drive capability of the scanning line WL4 weak.

In particular, if a condition that the emission control transistor M7 is completely turned off is satisfied during the write period (time t7 to time t8), a serious problem does not occur even if some current generated due to the compensation operation leaks to a light-emitting element during the compensation period (time t3 to t5). In the embodiment of the invention, since it is prioritized to suppress the black float by reducing the coupling current whose peak value is large, deterioration of the image quality is suppressed to the minimum.

In the present embodiment, since fluctuation of a driving current caused by variation of a threshold voltage of a driving transistor can be suppressed, a leak current while the driving transistor is in an OFF state (leak current at the time of black display) is reduced and the increase in black level caused by a coupling current is suppressed. As a result, black display corresponding to a desired level is reliably realized.

Fourth Embodiment

In this embodiment, it will be described about an electronic apparatus using the active-matrix-type light-emitting device according to the above embodiments of the invention.

In particular, the light-emitting device according to the embodiments of the invention is effectively used for small and portable electronic apparatuses, such as a mobile phone, a computer, a CD player, and a DVD player. It is needless to say that the invention is not limited thereto.

(1) Display Panel

Figure 10:
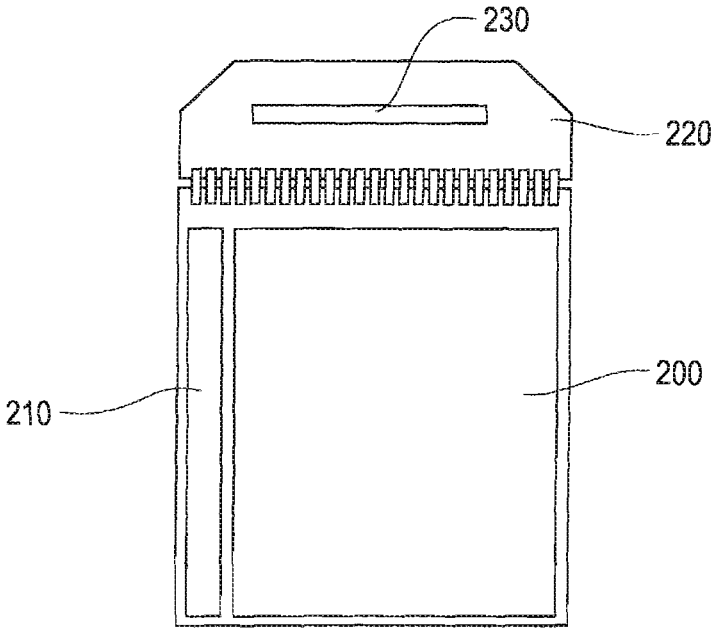
FIG. 10 is a view illustrating the entire layout configuration of a display panel using the active-matrix-type light-emitting device according to the embodiment of the invention.

FIG. 10 is a view illustrating the entire layout configuration of a display panel using the active-matrix-type light-emitting device according to the embodiment of the invention. The display panel includes an active-matrix-type organic EL element 200 having a voltage program type pixel, a scanning line driver 210 having a level shifter provided therein, a flexible TAB tape 220, and an external analog driver LSI 230 having a RAM/controller.

(2) Mobile Computer

Figure 11:
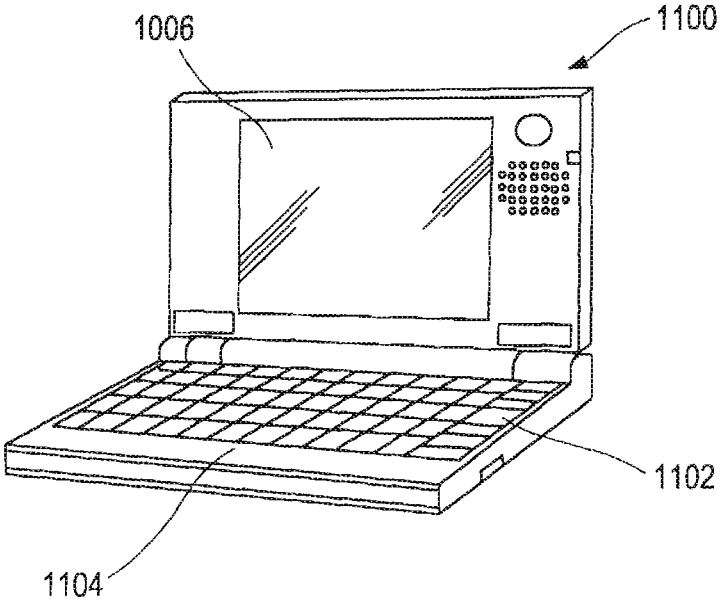
FIG. 11 is a perspective view illustrating the outer appearance of a mobile personal computer mounted with the display panel shown in FIG. 10.

FIG. 11 is a perspective view illustrating the outer appearance of a mobile personal computer mounted with the display panel shown in FIG. 10. Referring to FIG. 11, a personal computer 1100 has a main body 1104 including a keyboard 1102 and a display unit 1106.

(3) Mobile Phone

Figure 12:
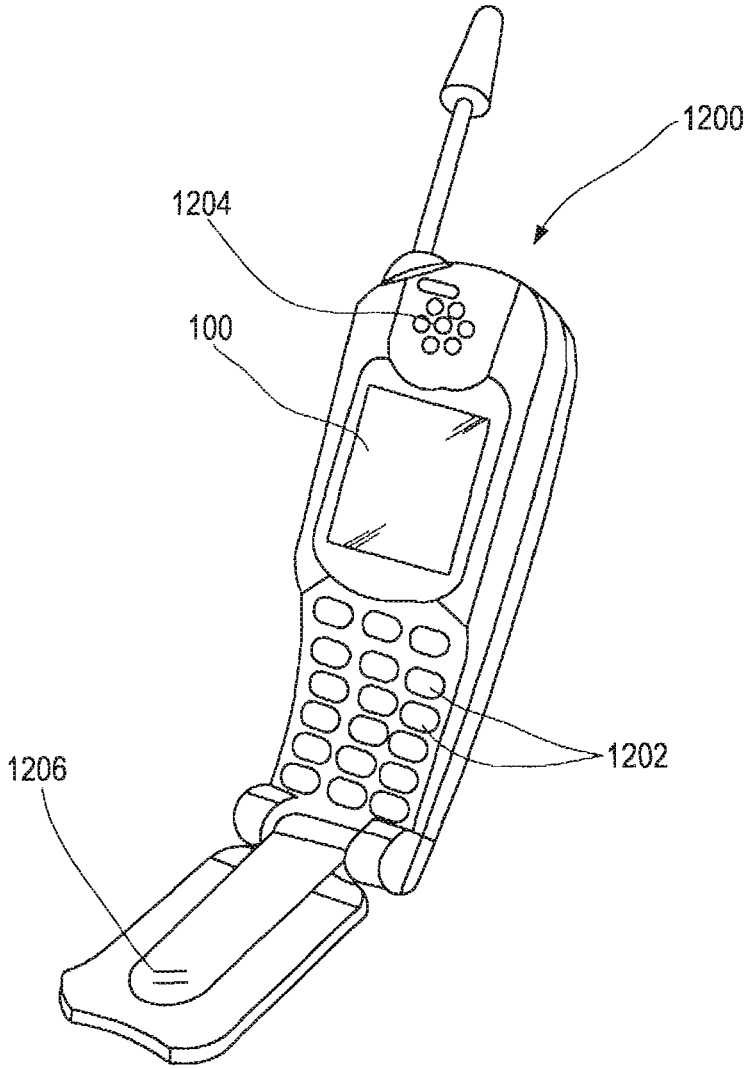
FIG. 12 is a perspective view schematically illustrating a mobile phone mounted with the display panel according to the embodiment of the invention.

FIG. 12 is a perspective view schematically illustrating a mobile phone mounted with the display panel according to the embodiment of the invention. A mobile phone 1200 includes a plurality of operation keys 1202, a speaker 1204, a microphone 1206, and the display panel 100 according to the embodiment of the invention.

(4) Digital Still Camera

Figure 13:
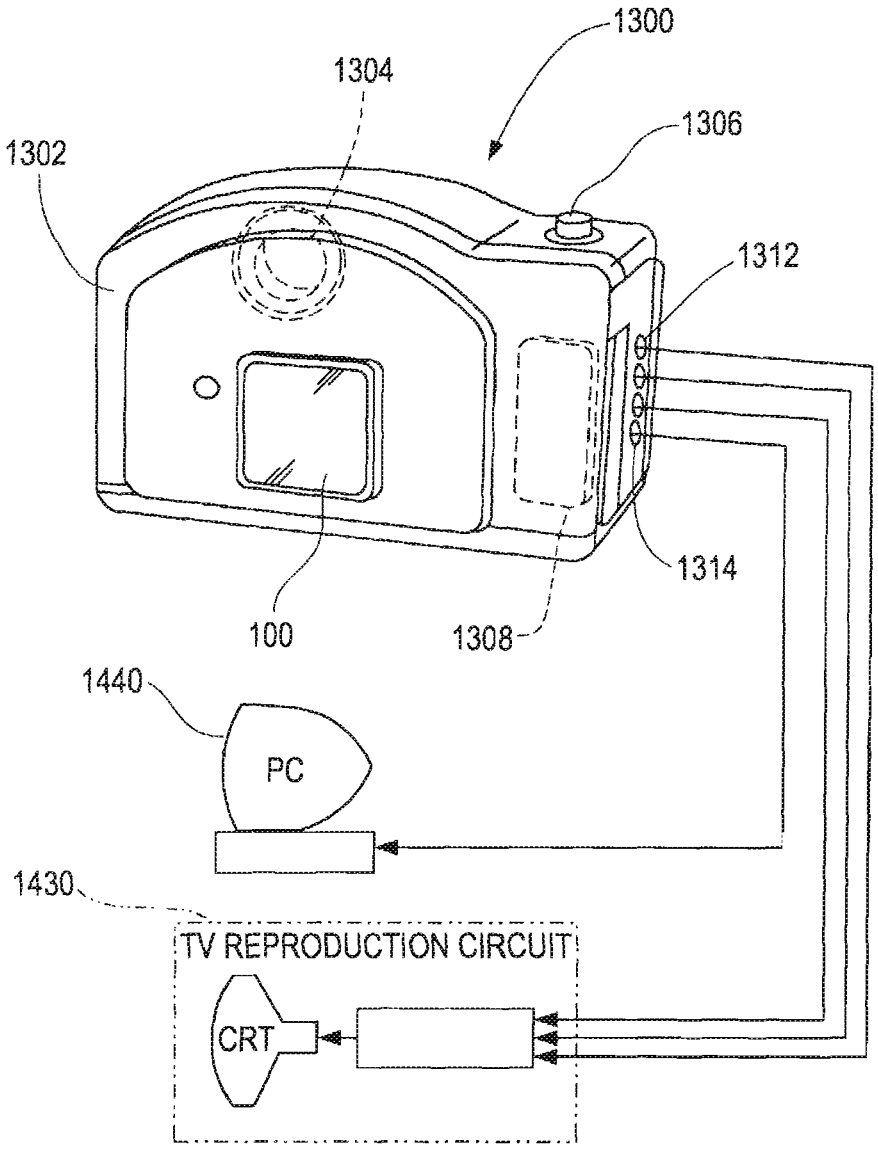
FIG. 13 is a view illustrating the outer appearance and operation mode of a digital still camera that uses the organic EL panel according to the embodiment of the invention as a finder.

FIG. 13 is a view illustrating the outer appearance and operation mode of a digital still camera that uses the organic EL panel according to the embodiment of the invention as a finder. A digital still camera 1300 includes an organic EL panel 100 that is provided on a rear surface of a housing 1302 in order to perform display on the basis of an image signal from a COD. Therefore, the organic EL panel 100 functions as a finder that displays a photographic subject. In addition, a light receiving unit 1304 having an optical lens and a CCD is provided on a front surface (rear side of the drawing) of the housing 1302.

When a photographer determines a photographic subject image displayed on the organic EL panel 100 and opens a shutter, an image signal from the CCD is transmitted and is then stored in a memory within a circuit board 1308. In the digital still camera 1300, a video signal output terminal 1312 and an input/output terminal 1314 for data communications are provided in a side surface of the housing 1302. As shown in the drawing, if necessary, a TV monitor 1430 and a personal computer 1440 are connected to the video signal terminal 1312 and the input/output terminal 1314, respectively. Through a predetermined operation, the image signal stored in the memory of the circuit board 1308 is output to the TV monitor 1430 and the personal computer 1440.

In addition to the electronic apparatuses described above, the light-emitting device according to the embodiment of the invention may be used as a display panel for a TV set, a view finder type or monitor direct view type video tape recorder, a PDA terminal, a car navigation system, an electronic note, a calculator, a word processor, a workstation, a TV phone, a POS system terminal, a device provided with a touch panel, and the like.

In addition, the light-emitting device according to the embodiment of the invention may also be used as a light source for a printer, for example. In addition, the pixel driving circuit according to the embodiment of the invention may be applied to a magnetoresistive RAM, a capacitance sensor, a charge sensor, a DNA sensor, an infrared camera, and many other apparatuses.

In addition, the pixel driving circuit according to the embodiment of the invention may be used to drive a laser diode (LD) or a light emitting diode as well as organic/inorganic EL elements.

As described above, according to the embodiment of the ion it is possible to effectively prevent the black float (phenomenon in which an unnecessary current flows even at the time of black display and a light-emitting element emit light a little to thereby raise a black level, and as a result, the contrast decreases) at the time of black display of an active-matrix-type light-emitting device having a self-luminous element, such as an electroluminescent (EL) element, without complicating the circuit configuration.

Further, according to the embodiment of the invention, even if an active-matrix-type light-emitting device is highly integrated such that emission control transistors and light-emitting elements are more closely disposed on a substrate, deterioration of the quality of a display image caused by the black float, which occurs due to the coupling current, does not cause any problem.

Furthermore, the invention may be applied to both an active-matrix-type light-emitting device based on a current programming method and an active-matrix-type light-emitting device based on a voltage programming method.

In the case of applying the invention to an active-matrix-type light-emitting device based on a voltage programming method in which variation of a threshold voltage of a driving TFT can be compensated, it is possible to suppress the fluctuation of a driving current caused by the variation of the threshold voltage of the driving transistor. Accordingly, a leak current while the driving transistor is in an OFF state (leak current at the time of black display) is reduced and the increase in black level caused by a coupling current is suppressed. As a result, the black display corresponding to a desired level is reliably realized.

In addition, the active-matrix-type light-emitting device according to the embodiment of the invention does not need to have a special circuit mounted therein. Accordingly, since an active circuit board does not need to be large, active-matrix-type light-emitting device according to the embodiment of the invention is appropriately mounted in a small electronic apparatus, such as a portable terminal.

The active-matrix-type light-emitting device according to the embodiment of the invention has an effect that decrease in the contrast at the time of black display is suppressed. Accordingly, the invention is useful as an active-matrix-type light-emitting device and a pixel driving method for the active-matrix-type light-emitting device. In particular, the invention is useful as a technique for preventing the black float at the time of black display of an active-matrix-type light-emitting device having a self-luminous element, such as an electroluminescent (EL) element.

The entire disclosure of Japanese Patent Application No. 2006-21-6956, filed Aug. 9, 2006 is expressly incorporated by reference herein.

What is claimed is:

1. An active-matrix-type light-emitting device comprising:

a pixel circuit including:

a light-emitting element, a holding capacitance that holds a voltage according to data, a driving transistor that supplies a driving current to the light-emitting element according to the voltage of the holding capacitance, a control transistor that writes the data to the holding capacitance when a write control signal is applied during a writing period, the control transistor including a first control transistor and a second control transistor, a gate of the first control transistor being connected to a gate of the second control transistor, and a light-emission control transistor that electrically connects between the light-emitting element and the driving transistor when an emission control signal is applied during an emission period that occurs after the writing period;

a first scanning line that supplies to the control transistor a writing control signal that controls ON/OFF of the control transistor;

a second scanning line that supplies to the light-emission control transistor a light-emitting control signal that controls ON/OFF of the light-emission control transistor;

a data line that supplies the data to the pixel circuit; and a first driver circuit that outputs the writing control signal to the first scanning line through a first output buffer, the first output buffer including a plurality of parallel-connected first transistors, and a second driver circuit that outputs the light-emitting control signal to the second scanning line through a second output buffer, the second output buffer including a plurality of parallel-connected second transistors, the number of the plurality of second transistors being smaller than the number of the plurality of first transistors, wherein a changing period, from a start of a change of an electric potential of the second scanning line to a convergence of the changing of the electric potential of the scanning line produced by supplying the second control signal, includes a first changing period and a second changing period, wherein the first changing period is produced by supplying one signal of the second control signal that controls ON of the light-emission control transistor, wherein the second changing period is produced by supplying other signal of the second control signal that controls OFF of the light-emission control transistor, and wherein the first changing period is shorter than one horizontal synchronization period (1H), and the second changing period is longer than the one horizontal synchronization period (1H).

2. The active-matrix-type light-emitting device according to claim 1, wherein the plurality of first and second transistors each include a plurality of transistors in which a ratio of a gate width and a gate length is the same, and the plurality of second transistors have a smaller number of the transistors in which the ratio of the gate width and the gate length is the same than the plurality of first transistors.

3. The active-matrix-type light-emitting device according to claim 1, wherein a gate width of the plurality of second transistors is shorter than the gate width of the plurality of first transistors.

4. The active-matrix-type light-emitting device according to claim 3, wherein a channel conductance (W/L) of one of the plurality of second transistors in the second output buffer is approximately one-fourth a channel conductance (W/L) of one of the plurality of first transistors in the first output buffer.

5. The active-matrix-type light-emitting device according to claim 1, wherein a resistance value of the second output buffer is higher than that of the first output buffer.

6. The active-matrix-type light-emitting device according to claim 1, wherein the driving transistor is an insulation gate type field effect transistor, and the current amount of a coupling current is reduced by decreasing a current drive capability associated with the second scanning line, such that unnecessary emission of the light-emitting element at the time of black display is suppressed, the coupling current being generated in a case when a changed component of an electric potential of the second scanning line leaks to the light-emitting element through a parasitic capacitance between a gate and a source of the light-emission control transistor when shifting the light-emission control transistor from an OFF state to an ON state by changing an electric potential of the second scanning line.

7. The active-matrix-type light-emitting device according to claim 1, wherein the light-emission control transistor and the light-emitting element are disposed on a substrate so as to be close to each other.

8. The active-matrix-type light-emitting device according to claim 1, wherein a current drive capability associated with the second scanning line is adjusted such that the second changing period is longer than the one horizontal synchronization period (1 H).

9. The active-matrix-type light-emitting device according to claim 1, wherein the control transistor driven through the first scanning line is a switching transistor connected between the data line and a common connection point between the holding capacitance and the driving transistor, the switching transistor performs an ON/OFF operation at least once during one horizontal synchronization period (1 H), and the light-emission control transistor driven through the second scanning line performs an ON/OFF operation at least once during a predetermined period within one vertical synchronization period (1 V).

10. The active-matrix-type light-emitting device according to claim 1, wherein the pixel circuit is a pixel circuit using a current programming method, in which an emission gray scale of the light-emitting element is adjusted by controlling electric charges held in the holding capacitance by means of a current flowing through the data line, or a pixel circuit using a voltage programming method, in which the emission gray scale of the light-emitting element is adjusted by controlling the electric charges held in the holding capacitance by means of a voltage signal transmitted through the data line.

11. The active-matrix-type light-emitting device according to claim 1, wherein the pixel circuit is a pixel circuit that uses a current programming method and has a circuit configuration for compensating for a change in a threshold voltage of an insulation gate type field effect transistor serving as the driving transistor, the control transistor driven through the first scanning line is a write transistor having an end connected to the data line and the other end connected to an end of a coupling capacitor, and the other end of the coupling capacitor is connected to a common connection point between the holding capacitance and the driving transistor.

12. The active-matrix-type light-emitting device according to claim 1, wherein the light-emitting element is an organic electroluminescent element (organic EL element).

13. An electronic apparatus comprising the active-matrix-type light-emitting device according to claim 1.

14. The electronic apparatus according to claim 13, wherein the active-matrix-type light-emitting device is used as a display device or a light source.

15. The active-matrix-type light emitting device according to claim 1, wherein a rate of voltage change during a rise or fall time of the light-emission control signal is lower than a rate of voltage change during a rise or fall time of the writing control signal.

16. A method of driving an active-matrix-type light-emitting device comprising:

a pixel circuit including:

a light-emitting element, a holding capacitance that holds a voltage according to data, a driving transistor that supplies a driving current to the light-emitting element according to the voltage of the holding capacitance, a control transistor that writes the data to the holding capacitance when a write control signal is applied during a writing period, the control transistor including a first control transistor and a second control transistor, a gate of the first control transistor being connected to a gate of the second control transistor, and a light-emission control transistor that electrically connects between the light-emitting element and the driving transistor when an emission control signal is applied during an emission period that occurs after the writing period;

a first scanning line that supplies to the control transistor a writing control signal that controls ON/OFF of the control transistor;

a second scanning line that supplies to the light-emission control transistor a light-emitting control signal that controls ON/OFF of the light-emission control transistor;

a data line that supplies the data to the pixel circuit; and a first driver circuit that outputs the writing control signal to the first scanning line through a first output buffer, the first output buffer including a plurality of parallel-connected first transistors, and a second driver circuit that outputs the light-emitting control signal to the second scanning line through a second output buffer, the second output buffer including a plurality of parallel-connected second transistors, the number of the plurality of second transistors being smaller than the number of the plurality of first transistors, the method comprising:

outputting the writing control signal to the first scanning line from the first driver circuit;

holding the voltage according to the data in the holding capacitance through the control transistor;

outputting the light-emitting control signal to the second scanning line from the second driver circuit; and supplying a driving current according to the voltage of the holding capacitance to the light-emitting element from the driving transistor through the light-emission control transistor, wherein a changing period, from a start of a change of an electric potential of the second scanning line to a convergence of the changing of the electric, potential of the scanning line produced by supplying the light-emitting control signal, includes a first changing period and a second changing period, wherein the first changing period is produced by supplying one signal of the light-emitting control signal that controls ON of the light-emission control transistor, wherein the second changing period is produced by supplying other signal of the light-emitting control signal that controls OFF of the light-emission control transistor, and wherein the first changing period is shorter than one horizontal synchronization period (1H), and the second changing period is longer than the one horizontal synchronization period (1H).

17. An active-matrix-type light emitting device comprising:

a pixel circuit including:

a light-emitting element, a holding capacitance that holds a voltage according to data, a driving transistor that supplies a driving current to the light-emitting element according to the voltage of the holding capacitance, a control transistor that writes the data to the holding capacitance when a write control signal is applied during a writing period, the control transistor including a first control transistor and a second control transistor, and a light-emission control transistor that electrically connects between the light-emitting element and the driving transistor when an emission control signal is applied during an emission period that occurs after the writing period;

a first scanning line that supplies to the control transistor a writing control signal that controls ON/OFF of the control transistor;

a second scanning line that supplies to the light-emission control transistor a light-emitting control signal that controls ON/OFF of the light-emission control transistor;

a data line that supplies the data to the pixel circuit; and a first driver circuit that outputs the writing control signal to the first scanning line through a first output buffer, the first output buffer including a plurality of parallel-connected first transistors, and a second driver circuit that outputs the light-emitting control signal to the second scanning line through a second output buffer, the second output buffer including a plurality of parallel-connected second transistors, a gate width of the plurality of second transistors being shorter than a gate width of the plurality of first transistors, wherein a changing period, from a start of a change of an electric potential of the second scanning line to a convergence of the changing of the electric potential of the scanning line produced by supplying the second control signal, includes a first changing period and a second changing period, wherein the first changing period is produced by supplying one signal of the second control signal that controls ON of the light-emission control transistor, wherein the second changing period is produced by supplying other signal of the second control signal that controls OFF of the light-emission control transistor, and wherein the first changing, period is shorter than one horizontal synchronization period (1H) and the second changing period is longer than the one horizontal synchronization period (1H).

* * * * *